US008440380B2

(12) United States Patent
Yamamoto et al.

(10) Patent No.: US 8,440,380 B2
(45) Date of Patent: May 14, 2013

(54) TONER AND METHOD FOR PRODUCING THE SAME

(75) Inventors: Atsushi Yamamoto, Shizuoka (JP); Takuya Kadota, Hyogo (JP); Yoshihiro Mikuriya, Hyogo (JP); Tsuyoshi Nozaki, Osaka (JP); Yoshimichi Ishikawa, Hyogo (JP); Kazuoki Fuwa, Hyogo (JP); Tomohiro Fukao, Osaka (JP); Tomoharu Miki, Osaka (JP); Masayuki Hagi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 298 days.

(21) Appl. No.: 12/960,953

(22) Filed: Dec. 6, 2010

(65) Prior Publication Data

US 2011/0164901 A1 Jul. 7, 2011

(30) Foreign Application Priority Data

Jan. 6, 2010 (JP) ..... 2010-001297

(51) Int. Cl.
*G03G 9/093* (2006.01)

(52) U.S. Cl.
USPC ..... 430/110.2; 430/109.3; 430/109.4; 430/110.1

(58) Field of Classification Search ..... 430/110.1, 430/110.2, 109.3, 109.4
See application file for complete search history.

(56) References Cited

U.S. PATENT DOCUMENTS

| | | | |
|---|---|---|---|
| 7,550,242 | B2 | 6/2009 | Nozaki et al. |
| 7,556,904 | B2 | 7/2009 | Kadota et al. |
| 7,556,906 | B2 | 7/2009 | Katoh et al. |
| 7,587,159 | B2 | 9/2009 | Fuwa et al. |
| 7,632,619 | B2 | 12/2009 | Mikuriya et al. |
| 7,635,549 | B2 | 12/2009 | Nakamura et al. |
| 7,678,522 | B2 | 3/2010 | Nakamura et al. |
| 7,695,885 | B2 | 4/2010 | Yasunaga et al. |
| 7,709,171 | B2 | 5/2010 | Yamamoto et al. |
| 7,720,428 | B2 | 5/2010 | Hagi et al. |
| 7,727,694 | B2 | 6/2010 | Murakami et al. |
| 7,749,671 | B2 | 7/2010 | Yamamoto et al. |
| 7,785,760 | B2 | 8/2010 | Yamamoto et al. |
| 7,811,735 | B2 | 10/2010 | Nakamura et al. |
| 7,817,946 | B2 | 10/2010 | Murakami et al. |
| 7,820,348 | B2 | 10/2010 | Hagi et al. |
| 7,829,254 | B2 | 11/2010 | Kurose et al. |
| 7,833,686 | B2 | 11/2010 | Kadota et al. |
| 7,838,193 | B2 | 11/2010 | Hagi et al. |
| 2007/0026335 | A1 | 2/2007 | Yamamoto et al. |
| 2007/0207399 | A1 | 9/2007 | Kadota et al. |
| 2007/0212630 | A1 | 9/2007 | Yasunaga et al. |
| 2007/0217842 | A1 | 9/2007 | Kato et al. |
| 2007/0218384 | A1 | 9/2007 | Matsumoto et al. |
| 2007/0218390 | A1 | 9/2007 | Nozaki et al. |
| 2007/0218393 | A1 | 9/2007 | Nozaki et al. |
| 2007/0238042 | A1 | 10/2007 | Yasunaga et al. |
| 2008/0069608 | A1 | 3/2008 | Katoh et al. |
| 2008/0069617 | A1 | 3/2008 | Matsumoto et al. |
| 2008/0070149 | A1 | 3/2008 | Kato et al. |
| 2008/0076054 | A1 | 3/2008 | Nozaki et al. |
| 2008/0081273 | A1 | 4/2008 | Murakami et al. |
| 2008/0096119 | A1 | 4/2008 | Yamamoto et al. |
| 2008/0101823 | A1 | 5/2008 | Katoh et al. |
| 2008/0131797 | A1 | 6/2008 | Ishikawa et al. |
| 2008/0153018 | A1 | 6/2008 | Mikuriya et al. |
| 2008/0159777 | A1 | 7/2008 | Fuwa et al. |
| 2008/0175630 | A1 | 7/2008 | Yasunaga et al. |
| 2008/0176159 | A1 | 7/2008 | Matsumoto et al. |
| 2008/0220357 | A1 | 9/2008 | Nozaki et al. |
| 2008/0226356 | A1 | 9/2008 | Yasunaga et al. |
| 2008/0227001 | A1 | 9/2008 | Kadota et al. |
| 2008/0227009 | A1 | 9/2008 | Fuwa et al. |
| 2008/0227013 | A1 | 9/2008 | Kadota et al. |
| 2008/0227016 | A1 | 9/2008 | Nozaki et al. |
| 2008/0232857 | A1 | 9/2008 | Matsumoto et al. |
| 2008/0233497 | A1 | 9/2008 | Yamamoto et al. |
| 2008/0233506 | A1 | 9/2008 | Hagi et al. |
| 2008/0233510 | A1 | 9/2008 | Nozaki et al. |
| 2008/0233511 | A1 | 9/2008 | Ishikawa et al. |
| 2008/0279591 | A1 | 11/2008 | Yasunaga et al. |
| 2008/0304875 | A1 | 12/2008 | Katoh et al. |
| 2009/0011357 | A1* | 1/2009 | Kawase et al. ..... 430/110.1 |
| 2009/0017391 | A1 | 1/2009 | Yamamoto et al. |
| 2009/0041511 | A1 | 2/2009 | Fuwa et al. |
| 2009/0052952 | A1 | 2/2009 | Katoh et al. |
| 2009/0117481 | A1 | 5/2009 | Yasunaga et al. |
| 2009/0162772 | A1 | 6/2009 | Fuwa et al. |
| 2009/0169270 | A1 | 7/2009 | Fuwa et al. |
| 2009/0186289 | A1 | 7/2009 | Nakamura et al. |
| 2009/0186291 | A1 | 7/2009 | Mikuriya et al. |
| 2009/0220879 | A1 | 9/2009 | Matsumoto et al. |
| 2009/0232542 | A1 | 9/2009 | Yamamoto et al. |
| 2009/0233199 | A1 | 9/2009 | Nozaki et al. |
| 2009/0257792 | A1 | 10/2009 | Nakamura et al. |
| 2009/0297975 | A1* | 12/2009 | Ishikawa et al. ..... 430/109.4 |
| 2009/0297976 | A1 | 12/2009 | Yamamoto et al. |
| 2010/0009282 | A1 | 1/2010 | Katoh et al. |
| 2010/0055603 | A1 | 3/2010 | Nozaki et al. |
| 2010/0068646 | A1 | 3/2010 | Yamamoto |
| 2010/0150609 | A1 | 6/2010 | Nozaki et al. |
| 2010/0227265 | A1 | 9/2010 | Matsumoto et al. |
| 2010/0239974 | A1 | 9/2010 | Nozaki et al. |
| 2010/0272481 | A1 | 10/2010 | Yamamoto et al. |
| 2010/0296848 | A1 | 11/2010 | Yamamoto et al. |

FOREIGN PATENT DOCUMENTS

| | | |
|---|---|---|
| JP | 2006-285188 | 10/2006 |
| JP | 2007-233169 | 9/2007 |
| JP | 2007-279689 | 10/2007 |
| JP | 2008-268353 | 11/2008 |

* cited by examiner

*Primary Examiner* — Hoa V Le

(74) *Attorney, Agent, or Firm* — Oblon, Spivak, McClelland, Maier & Neustadt, L.L.P.

(57) ABSTRACT

A toner containing core particles each containing at least a resin A having a polyester skeleton and a colorant; and vinyl resin fine particles each of which encapsulates a resin B having at least a polyester skeleton and an endothermic peak measured by differential scanning calorimeter (DSC) at 40° C. to 110° C., wherein the vinyl resin fine particles are attached onto each of the core particles.

11 Claims, 2 Drawing Sheets

TONER AND METHOD FOR PRODUCING THE SAME

BACKGROUND OF THE INVENTION

1. Field of the Invention

The present invention relates to a toner for developing a latent electrostatic image, which contains a vinyl resin attached onto a surface of the toner, and can be used in electrophotography, and to a method for producing the toner.

2. Description of the Related Art

As a toner used for an electrophotographic image forming method, a toner using polyester having excellent fixability is desired. Moreover, in order to obtain a fine image, a toner having a substantially spherical shape, and narrow particle size distribution, specifically, several micrometers, is desired. As a method for obtaining such toner (colored particles), the following methods are known: a dissolution suspension method, in which a binder resin such as a polyester resin, a colorant and a releasing agent are dissolved or dispersed in a solvent, and the dispersion liquid is dispersed in an aqueous medium so as to obtain colored particles; and an emulsification association method, in which fine particles of a polyester resin, a pigment and a releasing agent, etc. are aggregated in the presence of an aggregated salt, so as to adjust shapes of particles, to thereby obtain colored particles.

However, these toners, which are produced in an aqueous medium and contain a polyester resin as a main component, are likely to have a low chargeability, and it is difficult to use these toners in an electrophotographic process. Particularly, in one component developing process having less opportunity to charge a toner, since the toner is less charged, background smear, toner falling, or the like outstandingly occurs. Thus, demand has arisen for improvement of toner chargeability.

As one of the methods for improving the toner chargeability, a method of allowing a styrene-acrylic resin having excellent chargeability to exist on a toner surface has been known (see Japanese Patent Application Laid-Open (JP-A) No. 2006-285188).

However, in this method, since the polyester resin is covered with the styrene-acrylic resin, the polyester resin cannot exhibit excellent fixability, it inherently has.

In JP-A No. 2007-233169, disclosed is a toner for developing a latent electrostatic image, which satisfies both low temperature fixability and heat resistant storage stability, has excellent offset resistance, a controllable structure, and excellent charge amount without contamination of a developing device and other members/devices. Particularly, it discloses a toner having a core part which contains a binder resin having a polyester skeleton, a colorant, and a releasing agent, and a vinyl copolymer resin part, for the purpose of providing a non-magnetic toner for electrostatic charge development and a method for producing the toner, a developer using the toner, a toner container and an image forming apparatus.

The invention disclosed in JP-A No. 2007-233169 is similar to the present invention, in that the toner contains a core part containing a binder resin having a polyester skeleton, a colorant, and a releasing agent, and a shell part formed of a vinyl copolymer resin. However, in JP-A No. 2007-233169, the conventional problem that the toner cannot exhibit excellent fixability of the polyester resin has not been solved.

The toner disclosed in JP-A No. 2007-279689 contains a core part which contains a binder resin having a polyester skeleton, a colorant, and a releasing agent, and a shell part formed of a crystalline polyester resin having high polarity. In the case where the toner has such a structure, the toner has excellent fixability, but insufficient chargeability since the crystalline polyester resin having poor chargeability is located on the toner surface, and sufficient printing quality cannot be achieved.

The toner disclosed in JP-A No. 2008-268353 is a toner containing a crystalline polyester resin, and having a surface layer, which contains urethane, polyester, a styrene-acrylic resin and a crystalline polyester resin. However, even though such surface layer is provided on the toner, toner chargeability is not sufficient, and sufficient printing quality cannot be achieved.

BRIEF SUMMARY OF THE INVENTION

An object of the present invention is to provide a toner containing a polyester resin as a main component, which surface is coated with vinyl resin fine particles each encapsulating a polyester resin having excellent fixability so as to improve fixability, and a method for producing the toner.

Means for solving the problems are as follows.

<1> A toner including core particles each containing at least a resin A having a polyester skeleton and a colorant; and vinyl resin fine particles each of which encapsulates a resin B having at least a polyester skeleton and an endothermic peak measured by differential scanning calorimeter (DSC) at 40° C. to 110° C., wherein the vinyl resin fine particles are attached onto each of the core particles.

<2> The toner according to <1>, wherein the resin B contains a crystalline polyester resin.

<3> The toner according to <1>, wherein the ratio of the resin B in the vinyl resin fine particles is 10% by mass to 50% by mass.

<4> The toner according to <1>, wherein each of the vinyl resin fine particles is formed of a vinyl resin, which is a copolymer of a styrene monomer and another monomer, and wherein the ratio of the styrene monomer in the monomers is 80% by mass or more.

<5> The toner according to <1>, wherein each of the vinyl resin fine particles is formed of a vinyl resin, which is polystyrene.

<6> A method for producing a toner, including: dispersing or dissolving at least a resin A having a polyester skeleton and a colorant in an organic solvent so as to prepare an oil phase; preparing an aqueous phase containing at least a surfactant in an aqueous medium; dispersing the oil phase in the aqueous phase so as to prepare a dispersion liquid of core particles in which the core particles formed of the oil phase are dispersed; dispersing vinyl resin fine particles encapsulating a resin B having at least a polyester skeleton and an endothermic peak measured by differential scanning calorimeter (DSC) at 40° C. to 110° C. in an aqueous medium, so as to prepare a dispersion liquid of the vinyl resin fine particles; and adding the dispersion liquid of the vinyl resin fine particles to the dispersion liquid of the core particles so as to allow the vinyl resin fine particles to be attached onto a surface of each of the core particles.

<7> The method for producing a toner according to <6>, wherein the resin B contains a crystalline polyester resin.

<8> The method for producing a toner according to <6>, wherein the ratio of the resin B in the vinyl resin fine particles is 10% by mass to 50% by mass.

<9> The method for producing a toner according to <6>, wherein each of the vinyl resin fine particles is formed of a vinyl resin, which is a copolymer of a styrene monomer and another monomer, and wherein the ratio of the styrene monomer in the monomers is 80% by mass or more.

<10> The method for producing a toner according to <6>, wherein each of the vinyl resin fine particles is formed of a vinyl resin, which is polystyrene.

<11> A process cartridge including at least an image bearing member and a developing unit configured to develop a latent electrostatic image formed on the image bearing member using a toner so as to form a visible image, wherein a toner includes core particles each containing at least a resin A having a polyester skeleton and a colorant; and vinyl resin fine particles each of which encapsulates a resin B having at least a polyester skeleton and an endothermic peak measured by differential scanning calorimeter (DSC) at 40° C. to 110° C., and wherein the vinyl resin fine particles are attached onto each of the core particles.

<12> An image forming apparatus including: an image bearing member; a charging unit configured to uniformly charge a surface of the image bearing member; an exposing unit configured to expose the charged surface of the image bearing member so as to form the latent image thereon; a developing unit configured to supply a toner to the formed latent image on the surface of the image bearing member so as to form a visible image; a cleaning unit configured to clean the remaining toner on the surface of the image bearing member; a transferring unit configured to transfer the visible image on the surface of the image bearing member via an intermediate transfer medium or directly to a recording medium; and a fixing unit configured to fix the visible image on the recording medium; wherein the toner includes: core particles each containing at least a resin A having a polyester skeleton and a colorant; and vinyl resin fine particles each of which encapsulates a resin B having at least a polyester skeleton and an endothermic peak measured by differential scanning calorimeter (DSC) at 40° C. to 110° C., and wherein the vinyl resin fine particles are attached onto each of the core particles.

According to the present invention, a toner having excellent chargeability and low temperature fixability can be provided. Moreover, according to a method for producing a toner of the present invention, the crystalline polyester resin is encapsulated in a resin having relatively high grass transition temperature, so that the crystalline polyester resin having a melting point lower than that of the commonly used crystalline polyester resin can be present on the toner surface. Thus, the fixability in a low temperature range can be efficiently improved, even though the amount of the crystalline polyester resin to be added is relatively small.

By encapsulating the polyester resin inside the styrene resin particles being present on the toner surface, the polyester resin is exposed on the styrene resin particles upon fixation, so as to improve fixability. Particularly, since the crystalline polyester resin used as the polyester rein is encapsulated in the styrene resin fine particles, the viscosity of the crystalline polyester resin decreases immediately upon fixation, so that the crystalline polyester resin moves out of the styrene resin fine particles. Thereafter, the crystalline polyester resin is compatibilized with the polyester resin inside the toner, and decreases its viscosity, to thereby remarkably improve fixability. Since the crystalline polyester resin is encapsulated in the styrene resin, the decrease in the heat resistant storage stability and stress resistance, which are caused by the crystalline polyester resin, do not occur.

DETAILED DESCRIPTION OF THE INVENTION (Toner)

Figure 1:
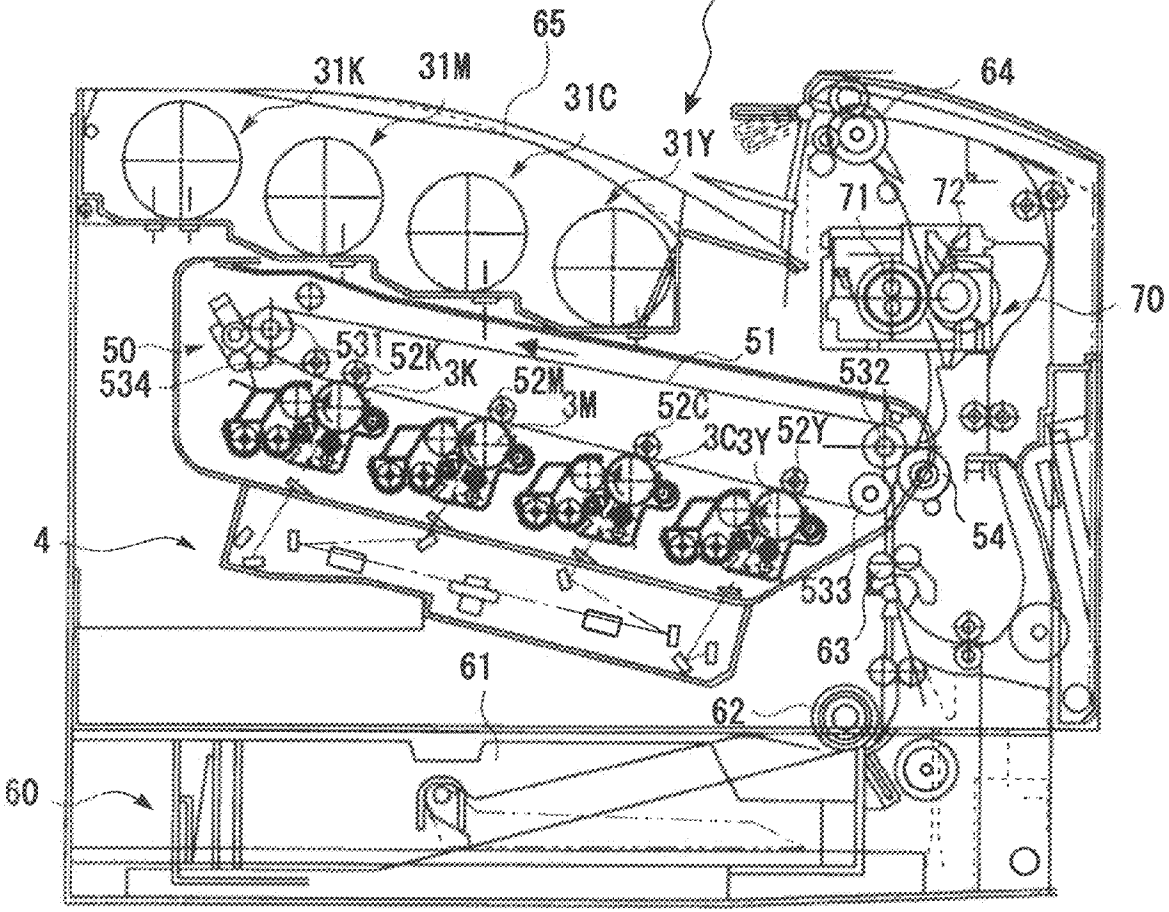
FIG. 1 shows a schematic construction of an image forming apparatus used in the present invention.

A toner of the present invention contains core particles each of which contains at least a resin A having a polyester skeleton and a colorant, and vinyl resin fine particles each of which encapsulates a resin B having at least a polyester skeleton and an endothermic peak measured by differential scanning calorimeter (DSC) at 40° C. to 110° C., wherein the vinyl resin fine particles are attached onto each of the core particles.

Namely, the polyester resin B having excellent fixability is encapsulated in the vinyl resin fine particles, which cover the surface of the core particle containing the polyester resin A as a main component.

The resulting toner preferably has an easily chargeable surface. In order to obtain such a toner surface, as a monomer forming a vinyl resin, a styrene monomer having an electron orbital on which an electron can stably exist similar to on an aromatic ring structure is used in a monomer mixture, in an amount of 50% by mass to 100% by mass, preferably 80% by mass to 100% by mass, more preferably 95% by mass to 100% by mass. When the amount of the styrene monomer is less than 50% by mass, the resultant colored fine particles have poor chargeability, and the application of the colored fine particles is limited.

Here, the term "styrene monomer" means an aromatic compound having a vinyl polymerizable functional group. Examples of the polymerizable functional group include a vinyl group, isopropenyl group, allyl group, acryloyl group, and methacryloyl group.

Examples of the styrene monomer include styrene, α-methylstyrene, 4-methylstyrene, 4-ethylstyrene, 4-tert-butylstyrene, 4-methoxystyrene, 4-ethoxystyrene, 4-carboxystyrene or metal salts thereof, 4-styrene sulfonic acid or metal salts thereof, 1-vinylnaphthalene, 2-vinylnaphthalene, allylbenzene, phenoxy alkylene glycol acrylate, phenoxy alkylene glycol methacrylate, phenoxy polyalkylene glycol acrylate, and phenoxy polyalkylene glycol methacrylate.

Among these, styrene monomers, it is preferred to mainly use styrene which is easily available, excellent in reactivity and has high chargeability.

In the vinyl resin, an acid monomer is used in an amount of from 0% by mass to 7% by mass, preferably in an amount of from 0% by mass to 4% by mass in the monomer mixture, and it is more preferred that no acid monomer be used in the monomer mixture. When the acid monomer is used in an amount more than 7% by mass, the resulting vinyl resin fine particle itself tends to have high dispersion stability, and thus the resulting vinyl resin fine particle is rarely attached onto a surface of each of core particles at normal temperature or easily desorbs therefrom although attached thereto even when the vinyl resin fine particle is added in a dispersion liquid in which the oil phase is dispersed in the aqueous phase. As a result, the vinyl resin fine particle is easily peeled off from the surface of each core particle in the course of performing desolvation, washing, drying and external addition processes. The amount of the acid monomer used is adjusted to 4% by mass or less, so as to reduce a change in chargeability of the resulting colored resin particles depending on the environment where they are used.

Here, the term "monomer" means a compound having a vinyl polymerizable functional group and an acid group. Examples of the acid group include a carboxylic acid group, a sulfonic acid group, and a phosphonic acid group.

Examples of the acid monomer include a carboxyl group-containing vinyl monomer or salts thereof, such as (meth) acrylic acid, maleic acid (anhydride), monoalkyl maleate, fumaric acid, monoalkyl fumarate, crotonic acid, itaconic acid, monoalkyl itaconate, itaconic acid glycol monoether, citraconic acid, monoalkyl citrate, and cinnamic acid; a sulfonic acid group-containing vinyl monomer, a vinyl sulfuric acid monoester or salts thereof; a phosphoric acid group-containing vinyl monomer or salts thereof.

Among these, (meth)acrylic acid, maleic acid (anhydride), monoalkyl maleate, fumaric acid, monoalkyl fumarate are preferable.

Moreover, copolymerization may be performed using a compound having a vinyl polymerizable functional group other than those described above. As such compound, vinyl ester is used and examples thereof include vinyl acetate, vinyl butyrate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinyl methoxyacetate, vinyl benzoate, ethyl-α-ethoxyacrylate, alkyl (meth)acrylates with an alkyl group having 1 to 50 carbon atoms (such as methyl (meth)acrylate, ethyl (meth)acrylate, propyl (meth) acrylate, butyl (meth)acrylate, 2-ethylhexyl (meth)acrylate, dodecyl (meth)acrylate, hexadecyl (meth)acrylate, heptadecyl (meth)acrylate, and eicosyl (meth)acrylate), dialkyl fumarates (the two alkyl groups have 2 to 8 carbon atoms and have a straight-chain, branched-chain, or alicyclic structure), dialkyl maleates (the two alkyl groups have 2 to 8 carbon atoms and have a straight-chain, branched-chain, or alicyclic structure), poly(meth)allyloxyalkanes (such as diallyloxyethane, triallyloxyethane, tetraallyloxyethane, tetraallyloxypropane, tetraallyloxybutane, and tetramethallyloxyethane); vinyl monomers having a polyalkylene glycol chain (such as polyethylene glycol (molecular weight of 300) mono (meth)acrylate, polypropylene glycol (molecular weight of 500) monoacrylate, ethylene oxide 10 mol adduct of methyl alcohol (meth)acrylate, ethylene oxide 30 mol adduct of lauryl alcohol (meth)acrylate); poly(meth)acrylates (such as poly(meth)acrylates of polyhydric alcohols, ethylene glycol di(meth)acrylate, propylene glycol di(meth)acrylate, neopentyl glycol di(meth)acrylate, trimethylolpropane tri(meth) acrylate, and polyethylene glycol di(meth)acrylate)); vinyl (thio)ethers (such as vinyl methyl ether, vinyl ethyl ether, vinyl propyl ether, vinyl butyl ether, vinyl-2-ethylhexyl ether, vinyl phenyl ether, vinyl-2-methoxyethyl ether, methoxybutadiene, vinyl-2-butoxyethyl ether, 3,4-dihydro-1,2-pyran, 2-butoxy-2'-vinyloxydiethyl ether, vinyl-2-ethylmercaptoethyl ether, acetoxystyrene, and phenoxystyrene); vinyl ketones (such as vinyl methyl ketone, vinyl ethyl ketone, and vinyl phenyl ketone); and vinyl sulfones (such as divinyl sulfide, p-vinyl diphenyl sulfide, vinyl ethyl sulfide, vinyl ethyl sulfone, divinyl sulfone, and divinyl sulfoxide).

The vinyl resin fine particles having a crystalline polyester resin may be obtained in the following manner: a monomer solution prepared by uniformly dissolving the crystalline polyester resin in a monomer is dispersed in an aqueous medium, then a radical is generated in the aqueous medium by using, for example, a polymerization initiator, and the radical enters the monomer droplet while reacting with the monomer, part of which is dissolved in the aqueous medium, so as to polymerize the monomer in the droplet, to thereby produce resin fine particles.

It is considered that, in this method, since the crystalline polyester resin becomes incompatible with a vinyl resin formed by the polymerization, as the polymerization progresses from the outside of the droplet due to the radical entering from the outside of the droplet of the monomer solution, the crystalline polyester resin is phase-separated and taken into the resin fine particles, to thereby finally obtain a dispersion solution of vinyl resin fine particles containing the crystalline polyester resin therein.

Alternatively, the vinyl resin fine particles containing the crystalline polyester resin can be obtained by a seed polymerization method, in which using a surfactant the crystalline polyester resin as a core particle is dispersed in an aqueous medium, and a monomer is added thereto to produce a monomer droplet containing the crystalline polyester resin, and then the monomer droplet is subjected to polymerization using a polymerization initiator. However, when the polymerization is performed at a temperature higher than the melting point of the crystalline polyester resin, the crystalline polyester resin is dissolved and the state of the system is changed, decreasing the dispersion stability of the monomer droplet, and the core particles are aggregated before the polymerization reaction. Thus, it is difficult to obtain desired resin fine particles. On that point, according to the polymerization method described in this specification, there is an advantage that a crystalline polyester resin having a melting point lower than the reaction temperature can be used.

As a polymerization initiator, known water-soluble polymerization initiator can be used. Examples thereof include hydrogen peroxide, ammonium persulfate, potassium persulfate, 4,4'-azobis-(4-cyanovaleric acid), 2,2'-azobis-(diaminopropane). The polymerization initiator is appropriately used together with a reducing agent as a redox initiator.

As a resin having a polyester skeleton used in the present invention, a resin at least part of which is dissolved in an organic solvent is used. The resin preferably has an acid value of 2 mgKOH/g to 24 mgKOH/g. When the acid value is more than 24 mgKOH/g, the resin easily migrates to an aqueous phase. As a result, problems easily occur, for example, mass balance decreases during production, or dispersion stability of oil phase decreases. On the other hand, when the acid value is less than 2 mgKOH/g, the polarity of the resin decreases, causing difficulty in uniformly dispersing a colorant having polarity to some extent in an oil phase.

Examples of the resin having a polyester skeleton include a polyester resin, and a block polymer of polyester and other polymers.

Examples of the polyester resin include ring-opening polymers of lactones, polycondensates of hydroxycarboxylic acid, and polycondensates of (1) polyol with (2) polycarboxylic acid. Among these, polycondensates of polyol with polycarboxylic acid are preferable from the viewpoint of the flexibility of design.

The peak molecular weight of the polyester resin is preferably 1,000 to 30,000, more preferably 1,500 to 10,000, and even more preferably 2,000 to 8,000. When the peak molecular weight is less than 1,000, the heat resistant storage stability may degrade. When it is more than 30,000, the low-temperature fixability of a toner for developing a latent electrostatic image may degrade.

<Polyol>

As polyol (1), diol (1-1) and trihydric or higher polyol (1-2) are exemplified. A single use of the diol (1-1) or a mixture of the diol (1-1) with a small amount of the trihydric or higher polyol (1-2) is preferable.

Examples of the diol (1-1) include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropyleneglycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); alkylene oxide (e.g., ethylene oxide, propylene oxide, butylene oxide) adducts of the above-described alicyclic diols; 4,4'-dihydroxybiphenyls (e.g., 3,3'-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as: tetrafluorobisphenol A), and 2,2-bis(3-hydroxyphenyl)-1,1,1,3,3,3-hexafluoropropane); bis(4-hydroxyphenyl)ethers (e.g., bis(3-fluoro-4-hydroxyphenyl)ether; and alkylene oxide (e.g., ethylene oxide, propylene oxide, butylene oxide) adducts of the above-described bisphenols.

Among these compounds, alkylene glycols having 2 to 12 carbon atoms and alkylene oxide adducts of bisphenols are preferably used, and alkylene oxide adducts of bisphenols and combinations of alkylene oxide adducts of bisphenols with alkylene glycols having 2 to 12 carbon atoms are more preferably used.

Examples of the trihydric or higher polyol (1-2) include trihydric to octahydric or higher polyhydric aliphatic alcohols (e.g., glycerin, trimethylolethane, trimethylolpropane, pentaerythritol, and sorbitol); trihydric and higher phenols (e.g., trisphenol PA, phenol novolac, and cresol novolac); and alkylene oxide adducts of the above-mentioned trihydric or higher polyphenols.

<Polycarboxylic Acid>

As polycarboxylic acid (2), dicarboxylic acid (2-1) and trivalent or higher polycarboxylic acid (2-2) are exemplified. A single use of the dicarboxylic acid (2-1) or a mixture of the dicarboxylic acid (2-1) with a small amount of the trivalent or higher polycarboxylic acid (2-2) is preferable.

Examples of the dicarboxylic acid (2-1) include alkylene dicarboxylic acids (e.g., succinic acid, adipic acid, and sebacic acid); alkenylene dicarboxylic acids (e.g., maleic acid and fumaric acid); and aromatic dicarboxylic acids (e.g., phthalic acid, isophthalic acid, terephthalic acid, naphthalene dicarboxylic acid); 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic anhydride).

Among these compounds, an alkenylene dicarboxylic acid having 4 to 20 carbon atoms, and an aromatic dicarboxylic acid having 8 to 20 carbon atoms are preferred.

As the trivalent or higher polycarboxylic acid (2-2), aromatic polycarboxylic acid having 9 to 20 carbon atoms (e.g., trimellitic acid and pyromellitic acid) are exemplified.

As the polycarboxylic acid (2), an acid anhydride or a lower alkyl ester (such as a methyl ester, ethyl ester, or isopropyl ester) described above can be used as a trivalent or higher polycarboxylic acid to react with the polyol (1).

Particularly, as the resin B having a polyester skeleton encapsulated in the vinyl resin fine particles, a crystalline polyester resin is advantageously used to improve fixability.

The crystalline polyester resin is a specific polyester resin prepared from an acid (dicarboxylic acid) component and an alcohol (diol) component. In the description of the polyester resin below, the configurational unit that has been an acid component before synthesizing the polyester resin will be referred to as an "acid-derived component", and the configurational unit that has been an alcohol component before synthesizing the polyester resin as an "alcohol-derived component".

In the present invention, "crystalline" in "crystalline polyester resin" refers to not a stepwise change in endotherm but presence of a sharp endothermic peak in a differential scanning calorimetery (DSC). In addition, an endothermic peak may refer to a peak having a width of 40° C. to 50° C. when the crystalline polyester resin is formed into a toner. In the present invention, in the case of a polymer in which other component is copolymerized with the main chain of the crystalline polyester resin, when the other component is 50% by mass or less, this copolymer is also called as a crystalline polyester resin.

Acid-Derived Component

Examples of the acids for the acid-derived component include various dicarboxylic acids, and the main acid-derived component in the specific polyester resin is preferably an aliphatic dicarboxylic acid, and particularly preferably a linear carboxylic acid.

Examples of the aliphatic dicarboxylic acid include, but not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid and lower alkyl esters and acid anhydrides thereof.

Examples of the aromatic dicarboxylic acid include terephthalic acid, isophthalic acid, orthophthalic acid, t-butylisophthalic acid, 2,6-naphthalinedicarboxylic acid and 4,4'-biphenyldicarboxylic acid.

In addition to the component derived from the aliphatic dicarboxylic acid and the component derived from aromatic dicarboxylic acid, the acid derived component may include a component such as a dicarboxylic-acid derived component having a double bond and a dicarboxylic-acid derived component having a sulfonic acid group.

The above dicarboxylic-acid derived component having a double bond includes components derived from lower alkyl esters or acid anhydrides of a dicarboxylic acid having a double bond, in addition to the dicarboxylic-acid derived component having a double bond.

The dicarboxylic acid having a double bond can be preferably used so as to prevent hot-offset upon fixation because an entire resin can be crosslinked by using the double bond therein. Examples of such a dicarboxylic acid include, but not limited to, fumaric acid, maleic acid, 3-hexenedioic acid, and 3-octenedioic acid. Additionally, examples thereof include lower alkyl esters, and acid anhydrides thereof. Of these, fumaric acid and maleic acid are preferable in terms of cost.

When the content of the dicarboxylic-acid derived component having a double bond in the total acid-derived components included in the crystalline polyester resin is preferably 20 constituting mole % or less, and more preferably 2 constituting mole % to 10 constituting mole %.

When the content is more than 20 constituting mole %, the crystallinity of the polyester resin decreases, the melting point thereof lowers, possibly causing decrease of image storage stability.

In the specification, "constituting mole %" is the percentage when the acid-derived component in the total acid-derived components in a polyester, or the alcohol constitutional component in the total alcohol-derived components in a polyester is taken as 1 unit (mole), respectively.

Alcohol-Derived Component

As an alcohol which is to be an alcohol-derived component, an aliphatic diol is preferable, and a linear aliphatic diol having 7 to 20 carbon atoms is more preferable. When the branched aliphatic diol is used, the crystallinity of a polyester resin decreases and a melting point decreases. Thus, an image is formed using an electrophotographic toner obtained by a method for producing an electrophotographic toner described below, the toner blocking resistance, image storage stability, and low-temperature fixability may be deteriorated. When the number of carbon atom in the chain is less than 7, in the case where the diol is polycondensed with aromatic dicarboxylic acid, the melting point increases, possibly causing difficulty in fixation at low temperature. On the other hand, when the number of carbon atom in the chain more than 20, it may be difficult to obtain material for practical use. The number of carbon atom in the chain is more preferably 14 or less.

When polyester is obtained by polycondension of the diols with aromatic dicarboxylic acid, the number of carbon atom in the chain is preferably an odd number. When the number of carbon atom in the chain is an odd number, the melting temperature of a polyester resin becomes lower than the case where the number of carbon atom in the chain is an even number, and the melting temperature easily falls within a numerical value range which will be described later.

Examples of the aliphatic diols include, but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanedecanediol. Among these, in view of easy availability, 1,8-octanediol, 1,9-nonanediol, 1,10-decanediol are preferable. Moreover, in terms of low melting point, 1,9-nonanediol is preferable.

A content of the aliphatic diol-derived component in the total alcohol-derived component included in the crystalline polyester resin is 80 constituting mole % or more. If necessary, components other than the aliphatic diol-derived component may be contained as the alcohol-derived component. As the alcohol-derived component, the content of the aliphatic diol-derived component is preferably 90 constituting mole % or more, relative to the total content of the alcohol-derived component.

When the content of the aliphatic diol-derived component is less than 80 constituting mole %, the crystallinity of a polyester resin decreases, and the melting point decreases, possibly causing deterioration of the toner blocking resistance, image storage stability, and low-temperature fixability.

Examples of the other components contained in the aliphatic diol-derived component if necessary include a diol-derived component having a double bond, and a diol-derived component having a sulfonic acid group.

Examples of the diol having a double bond include 2-butene-1,4-diol, 3-butene-1,6-diol, and 4-butene-1,8-diol. The content of the diol-derived component having a double bond in the total acid-derived component is preferably 20 constituting mole % or less, and more preferably 2 constituting mole % to 10 constituting mole %.

When the content is more than 20 constituting mole %, the crystallinity of the polyester resin decreases, and the melting point decreases, possibly causing decrease of image storage stability.

The endothermic peak of the crystalline polyester resin by DSC measurement is preferably 40° C. to 110° C., more preferably 40° C. to 100° C., and even more preferably 55° C. to 90° C. When the endothermic peak is lower than 40° C., powder may easily aggregate, and storage stability of a fixed image may decrease. When the endothermic peak is higher than 110° C., low temperature fixation may not be achieved.

The method for producing the crystalline polyester resin is not particularly limited and it can be produced by reacting an acid component and an alcohol component in accordance with the commonly used polyester polymerization method. Examples of such a method include direct polycondensation and ester exchange. An appropriate method is selected, depending on the types of the monomers. A molar ratio (acid component/alcohol component) when the acid component and the alcohol component are reacted cannot be unequivocally set because it varies, depending on reaction conditions and the like. But, it is typically about 1/1.

The crystalline polyester resin can be produced at a polymerization temperature ranging from 180° C. to 230° C., and if necessary, the polymerization reaction is performed while reducing the pressure in the reaction system and removing water or alcohol generated during condensation.

When the monomer does not show solubility or compatibility under a reaction temperature, a high-boiling-point solvent may be added as a dissolution aid to cause dissolution. The polycondensation reaction is performed while distilling off the dissolution aid. When a monomer having poor compatibility is present in the copolymerization reaction, it is recommended to condense the monomer, which has poor compatibility, with an acid component or an alcohol component to be polycondensed with the monomer in advance and then carry out polycondensation with the main component.

Examples of the catalyst usable for production of the crystalline polyester resin include alkali metal compounds such as sodium and lithium, alkaline earth metal compounds such as magnesium and calcium, metal compounds with zinc, manganese, antimony, titanium, tin, zirconium, germanium, or the like, phosphorous acid compounds, phosphoric acid compounds, and amine compounds. Following are specific examples of the catalyst.

Examples thereof include sodium acetate, sodium carbonate, lithium acetate, lithium carbonate, calcium acetate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octoate, germanium oxide, triphenyl phosphite, tris(2,4-di-t-butylphenyl)phosphite, ethyltriphenyl phosphonium bromide, triethylamine, and triphenylamine.

<Modified Resin>

When the mechanical strength of the resulting toner (colored resin particles) is increased and the toner (colored resin particles) are used as a toner for developing a latent electrostatic image, for the purpose of preventing high-temperature offset in fixation of images in addition to increasing the mechanical strength, a modified resin having an isocyanate group in its terminal may be dissolved in the oil phase to thereby obtain the toner (colored resin particles). Examples of the method of obtaining the modified resin include a method in which a polyester resin is subjected to a polymerization reaction together with a monomer containing an isocyanate to thereby obtain a resin having an isocyanate group; and a method in which a resin having an active hydrogen in its terminal is obtained by polymerization and then the resin is reacted with a polyisocyanate to thereby introduce an isocyanate group into the terminal of polymer. Of these two methods, the latter method is preferably employed in terms of the controllability of introducing an isocyanate group into the terminal of polymer. Examples of the active hydrogen include a hydroxyl group (e.g., alcoholic hydroxyl group, and phenolic hydroxyl group), an amino group, a carboxyl group, and a mercapto group. Among these groups, an alcoholic hydroxyl group is preferable. As a skeleton of the modified resin, it is preferable to use the same skeleton of the resin to be dissolved in the organic solvent, in consideration of the uniformity of the resulting resin particles, and thus preferably, the modified resin has a polyester skeleton. As a method of obtaining a resin having an alcoholic hydroxyl group in the terminal of polyester, in the polycondensation of the polyol and the polycarboxylic acid, it is advisable to increase the number of functional groups of the polyol higher than the number of functional groups of the polycarboxylic acid.

<Amine Compound>

The isocyanate group of the modified resin is hydrolyzed and part of the isocyanate group becomes an amino group in the course of obtaining particles by dispersing an oil phase in an aqueous phase. The generated amino group reacts with an isocyanate group which has not reacted, so as to promote elongation reaction. Other than the above reaction, an amine compound can be used in combination, in order to surely perform the elongation reaction or introduce crosslinking points. Examples of the amine compound (B) include diamines (B1), trivalent or higher polyamines (B2), amino alcohols (B3), amino mercaptans (B4), amino acids (B5), and compounds (B6) obtained by blocking amino groups of (B1) to (B5).

Examples of the diamines (B1) include aromatic diamines such as phenylenediamine, diethyltoluenediamine, 4,4'-diaminodiphenylmethane, tetrafluoro-p-xylylenediamine, tetrafluoro-p-phenylenediamine, etc.; alicyclic diamines such as 4,4'-diamino-3,3'-dimethyldicyclohexylmethane, diaminecyclohexane, isophoronediamine, etc.; and aliphatic diamines such as ethylenediamine, tetramethylenediamine, hexamethylenediamine, dodecafluoro hexylene diamine and tetracosafluoro dodesilenediamine, etc.

Examples of the trivalent or higher polyamines (B2) include diethylenetriamine and triethylenetetramine.

Examples of the amino alcohols (B3) include ethanolamine and hydroxyethylaniline.

Examples of the amino mercaptans (B4) include aminoethyl mercaptan and aminopropyl mercaptan.

Examples of the amino acids (B5) include aminopropionic acid and aminocaproic acid.

Examples of the compounds (B6) obtained by blocking amino groups of (B1) to (B5), include oxazoline compounds and ketimine compounds derived from the amines of (B1) to (B5) and ketones such as acetone, methyl ethyl ketone, methyl isobutyl ketone, etc. Among these amines (B), preference is given to the diamines (B1), and mixtures each composed of any of the diamines (B1) and a small amount of any of the trivalent or higher polyamines (B2).

<Organic Solvent>

As the organic solvent, a volatile organic solvent having a boiling point of less than 100° C. is preferable from the viewpoint of easiness of removal of the solvent in the following step. Specific examples of the organic solvent include toluene, xylene, benzene, tetrachloride carbon, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination.

When the resin to be dissolved or dispersed in an organic solvent is a resin having a polyester skeleton, it is preferable to use an ester solvent such as methyl acetate, ethyl acetate, and butyl acetate or a ketone-based solvent such as methyl ethyl ketone and, methyl isobutyl ketone, because the resin is highly soluble in the solvent. Among these organic solvents, methyl acetate, ethyl acetate and methyl ethyl ketone are particularly preferable for their high removability.

<Aqueous Medium>

As the aqueous medium, water may be used alone but a solvent miscible with water may also be used in combination with water. Examples of the solvent miscible with water include alcohols (e.g., methanol, isopropanol, ethylene glycol), dimethylformamide, tetrahydrofuran, cellosolves (e.g., methylcellosolve) and lower ketones (e.g., acetone, and methyl ethyl ketone).

<Surfactant>

A surfactant is used for dispersing an oil phase in the aqueous medium to produce liquid droplets.

Examples of the surfactant include anionic surfactants such as alkylbenzene sulfonate, α-olefin sulfonate, and phosphate ester; cationic surfactants such as amine salt surfactant (e.g., alkylamine salt, amino alcohol fatty acid derivative, polyamine fatty acid derivative, and imidazoline), and quaternary ammonium salt (e.g., alkyl trimethyl ammonium salt, dialkyldimethyl ammonium salt, alkyl dimethylbenzyl ammonium salt, pyridinium salt, alkyl isoquinolinium salt, and benzethonium chloride); nonionic surfactants (e.g., fatty acid amide derivative, and polyhydric alcohol derivative); and ampholytic surfactants (e.g., alanine, dodecyldi(aminoethyl) glycine, di(octylaminoethyl)glycine, and N-alkyl N,N-dimethylammonium betaine). With use of a surfactant having a fluoroalkyl group, with a small amount thereof an oil phase is dispersed in the aqueous medium to produce liquid droplets.

Preferred examples of the anionic surfactant having a fluoroalkyl group include fluoroalkyl carboxylic acid having 2 to 10 carbon atoms and metal salts thereof, disodium perfluorooctane sulfonyl glutamic acid, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid or its metal salt, perfluoroalkyl carboxylic acid (C7 to C13) and metal salts thereof, perfluoroalkyl (C4 to C12) sulfonate and metal salts thereof, perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salt, perfluoroalkyl (C6 to C10)-N-ethylsulfonyl glycine salt, and mono perfluoroalkyl (C6 to C16) ethylphosphate ester. Examples of the cationic surfactant include aliphatic primary or secondary amine having a fluoroalkyl group, aliphatic quaternary ammonium salt, such as perfluoroalkyl (C6 to C10) sulfonamide propyl trimethyl ammonium salt, benzalkonium salt, benzethonium chloride, pyridinium salt, and imidazolinium salt.

<Inorganic Dispersant>

A solution or dispersion of a toner composition may be dispersed in the above-mentioned aqueous medium in which an inorganic dispersant is or resin fine particles are present. As the inorganic dispersant, tricalcium phosphate, calcium carbonate, titanium oxide, colloidal silica, and hydroxyapatite can be used. It is preferable to use a dispersant in that a sharper particle size distribution and a stable dispersion can be obtained.

<Protective Colloid>

Further, a polymer-based protective colloid may be used to stabilize dispersion liquid droplets. Specific examples thereof include acids such as acrylic acid, methacrylic acid, α-cyanoacrylic acid, α-cyanomethacrylic acid, itaconic acid, crotonic acid, fumaric acid, maleic acid, and maleic anhydride;

(meth)acrylic monomer having hydroxyl group such as β-hydroxyethyl acrylic acid, β-hydroxyethyl methacrylic acid, 3-hydroxypropyl acrylic acid, 3-hydroxypropyl methacrylic acid, γ-hydroxypropyl acrylic acid, γ-hydroxypropyl methacrylic acid, 3-chloro-2-hydroxypropyl acrylic acid, 3-chloro-2-hydroxypropyl methacrylic acid, diethylene glycol monoacrylate, diethylene glycol monomethacrylate, glycerin monoacrylate, glycerin monomethacrylate, N-methylol acrylamide, and N-methylol methacrylamide; vinyl alcohols or vinyl alcohol ethers such as vinyl methyl ether, vinyl ethyl ether, and vinyl propyl ether; esters of vinyl alcohol with a compound having a carboxyl group such as vinyl acetate, vinyl propionate, and vinyl butyrate; acrylamide, methacrylamide, diacetone acrylamide or methylol compound thereof; acid chlorides such as acrylic acid chloride, and methacrylic acid chloride; homopolymers or copolymers having nitrogen atoms or a heterocyclic ring of nitrogen atom such as vinylpyridine, vinylpyrrolidone, vinylimidazole, and ethyleneimine; polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester; and celluloses such as methyl cellulose, hydroxyethyl cellulose, and hydroxypropyl cellulose.

Note that when an acid such as calcium phosphate or an alkali-soluble compound is used as a dispersion stabilizer, calcium phosphate salt is removed from fine particles by a method in which the calcium phosphate salt is dissolved by an acid (e.g., hydrochloric acid) and then washed with water. Besides, the calcium phosphate salt can also be removed by decomposition with enzyme. When a dispersant is used, the dispersant may remain on surfaces of toner particles, however, from the view point of chargeability of toner, it is preferable to wash out and remove the dispersant after chain-extending and/or crosslinking reaction.

<Colorant>

As the colorant, any known dyes and pigments can be used. Examples thereof include, but not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and mixtures thereof.

<Masterbatch of Colorant>

A colorant for use in the present invention can also be used as a masterbatch compounded with a resin.

Examples of a binder resin to be used in production of a masterbatch or kneaded together with a masterbatch, besides the above-mentioned modified or unmodified polyester resin, include styrene and polymers of substitution product thereof such as polystyrene, poly(p-chlorostyrene), and polyvinyltoluene; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-chloromethyl methacrylate copolymer, a styrene-acrylonitrile copolymer, a styrene-vinylmethylketone copolymer, a styrene-butadiene copolymer, a styrene-isoprene copolymer, a styrene-acrylonitrile-indene copolymer, a styrene-maleic acid copolymer, and a styrene-maleic acid ester copolymer); polymethyl methacrylate, polybutyl methacrylate, polyvinyl chloride, polyvinyl acetate, polyethylene, polypropylene, polyester, an epoxy resin, an epoxy polyol resin, polyurethane, polyamide, polyvinyl butyral, polyacrylic resin, rosin, modified rosin, a terpene resin, an aliphatic hydrocarbon resin, an alicyclic hydrocarbon resin, an aromatic petroleum resin, chlorinated paraffin, and paraffin wax. These may be used alone or in combination.

<Production Method of Masterbatch>

The masterbatch can be obtained by mixing and kneading the resin for masterbatch and the colorant under application of high shear force. On that occasion, it is possible to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used.

<Releasing Agent>

In addition, when the colored resin particle is used as a toner for developing a latent electrostatic image, a releasing agent may be dispersed in an organic solvent for the purpose of improving fixing-releasability.

As the releasing agent, a material which exhibits a sufficiently low viscosity, such as wax or silicone oil, when heated in a fixing process and which is difficult to be soluble in or swollen on materials other than colored resin particles and the surface of a fixing member is used. In consideration of the storage stability of colored resin particle itself, it is preferable to use a wax which usually exists as a solid in colored resin particles during storage.

Examples of the wax include long-chain hydrocarbons and carbonyl group-containing waxes. Examples of the long-chain hydrocarbons include polyolefin waxes (e.g., polyethylene wax, and polypropylene wax); petroleum waxes (e.g., paraffin wax, Sazole wax, and microcrystalline wax); and Fischer-Tropsh wax.

Examples of the carbonyl group-containing wax include polyalkanate esters (e.g. carnauba wax, montan wax, trimethylolpropane tribehenate, pentaerythritol tetrabehenate, pentaerythritol diacetate dibehenate, glycerine tribehenate, and 1,18-octadecanediol distearate), polyalkanol esters (e.g. tristearyl trimellitate and distearyl maleate), polyalkanic acid amides (e.g. ethylenediamine dibehenyl amide), polyalkyl amides (e.g. tristearyl trimellitate amide), and dialkyl ketones (e.g. distearyl ketone).

Among these, long-chain hydrocarbons are particularly preferable for their excellence in releasability. Further, when long-chain hydrocarbon is used as a releasing agent, a carbonyl group-containing wax may be used in combination.

<Charge Controlling Agent>

Further, a charge controlling agent may be dissolved or dispersed in the organic solvent, as necessary.

The charge controlling agent is not particularly limited, and any known charge controlling agents can be used. Examples thereof include nigrosine based dyes, triphenylmethane based dyes, chromium containing metal complex dyes, molybdic acid chelate pigments, rhodamine based dyes, alkoxy based amines, quaternary ammonium salts (including fluorine modified quaternary ammonium salts), alkyl amide, a simple substance of phosphorus or compounds thereof, a simple substance of tungsten or compounds thereof, fluorine based active agents, metal salts of salicylic acid and metal salts of salicylate derivatives. Specific examples of the charge controlling agent include BONTRON 03 of the nigrosine based dye, BONTRON P-51 of the quaternary ammonium salt, BONTRON S-34 of the metal-containing azo dye, E-82 of oxynaphthoic acid-based metal complex, E-84 of salicylic acid-based metal complex, E-89 of phenol-based condensate (manufactured by Orient Chemical Industries Ltd.); TP-302 and TP-415 of a quaternary ammonium salt molybdenum complex (manufactured by Hodogaya Chemical Co., Ltd.); Copy Charge PSY VP2038 of the quaternary ammonium salt, Copy Blue PR of the triphenylmethane derivative, Copy Charge NEG VP2036 and Copy Charge NX VP434 of the quaternary ammonium salt (manufactured by Hoechst); LRA-901, and LR-147 which is a boron complex (manufactured by Japan Carlit Co., Ltd.); copper phthalocyanine, perylene, quinacridone, azo-based pigments, and polymer compounds having functional groups such as sulfonic acid group, carboxyl group, and quaternary ammonium salt.

(Method for Producing Toner)

A method for producing a toner, includes dispersing or dissolving at least a resin A having a polyester skeleton and a colorant in an organic solvent so as to prepare an oil phase; preparing an aqueous phase containing at least a surfactant in an aqueous medium; dispersing the oil phase in the aqueous phase so as to prepare a dispersion liquid of core particles in which the core particles formed of the oil phase are dispersed; dispersing vinyl resin fine particles each encapsulating a resin B having at least a polyester skeleton and an endothermic peak measured by differential scanning calorimeter (DSC) at 40° C. to 110° C. in an aqueous medium, so as to prepare a dispersion liquid of the vinyl resin fine particles; and adding the dispersion liquid of the vinyl resin fine particles to the dispersion liquid of the core particles so as to allow the vinyl resin fine particles to be attached onto a surface of each of the core particles.

(Oil Phase Production Step)

As a method of producing an oil phase in which a resin, a colorant and the like are dissolved or dispersed in an organic solvent, the resin, colorant and the like may be gradually added into an organic solvent while the organic solvent being stirred, so that the resin, colorant and the like are dissolved or dispersed therein. When a pigment is used as a colorant, and/or when agents among releasing agents and charge controlling agents which are sparingly dissolved in an organic solvent are added, it is preferable to make particles small in size prior to addition to the organic solvent.

As described above, preparation of a masterbatch of the colorant is one method, and a similar procedure can be employed for such releasing agents and charge controlling agents.

As another method, a dispersion auxiliary is added as necessary, and a colorant, releasing agent, charge controlling agent are dispersed in wet process in an organic solvent, thereby obtaining a wet master.

As still another method, when a material which can be dissolved at a temperature lower than the boiling point of an organic solvent is to be dispersed, a dispersion auxiliary is added to the material as necessary in the organic solvent, and heated while being stirred together with the dispersoid so as to dissolve the material once, followed by cooling while being stirred or applying a shearing force thereto so as to be crystallized, thereby generating microcrystals of the dispersoid.

The colorant, releasing agent and charge controlling agent dispersed in an organic solvent using the above method may be further subjected to dispersion treatment after being dissolved or dispersed with the resin. In dispersion treatment, a known dispersing machine such as a bead mill and disc mill can be used.

(Core Particle Production Step)

A method of producing a dispersion liquid in which core particles containing an oil phase are dispersed, the dispersing liquid being produced by dispersing the oil phase obtained in the step described above is dispersed in an aqueous medium containing at least a surfactant, is not particularly limited, but known methods such as low-speed shearing method, high-speed shearing method, frictional method, high-pressure jet method and a method of using ultrasonic method may be applied. Among these, the high-speed searing method is preferable for adjusting the particle diameter of the dispersion to 2 μm to 20 μm. The rotational frequency of a high speed shearing dispersion machine is not particularly limited, but it is typically 1,000 rpm to 30,000 rpm and preferably 5,000 rpm to 20,000 rpm. The dispersion time period is not particularly limited, but it is typically 0.1 minutes to 5 minutes in the case of a batch mode. When the dispersion time is more than 5 minutes, undesired small-diameter particles may remain, and the system may be excessively dispersed and becomes unstable, causing aggregated particles and coarse particles. The temperature during dispersion is typically 0° C. to 40° C., and preferably 10° C. to 30° C. When the temperature during dispersion is higher than 40° C., unfavorably, movement of molecules is activated and the dispersion stability degrades, easily causing aggregated particles and coarse particles. When the temperature during dispersion is less than 0° C., the viscosity of the dispersion becomes higher, and thus the production efficiency degrades due to an increased shearing force energy required for dispersion.

<Resin Fine Particle-Attaching Step>

In the obtained core particle dispersion liquid, liquid droplets of core particles can be stably present during a stirring treatment. In this state, the dispersion liquid of the vinyl resin fine particles is introduced into the core particle dispersion liquid to thereby cause vinyl resin fine particles to be attached onto surfaces of core particles. The introduction of the dispersion liquid of the vinyl resin fine particle is preferably performed for 30 seconds or longer. When the introducing time is less than 30 seconds, unfavorably, the dispersion system rapidly changes in quality, causing occurrence of aggregated particles and nonuniform attachment of vinyl resin fine particles on surfaces of core particles. In contrast, when the dispersion liquid of the vinyl resin fine particles is added for a long period of time, for example, for longer than 60 minutes, it is unfavorable in terms of production efficiency.

The dispersion liquid of the vinyl resin fine particles may be diluted or condensed before being introduced to the core particle dispersion liquid, for the purpose of appropriately adjusting the concentration. The concentration of the dispersion liquid of the vinyl resin fine particles is preferably from 5% by mass to 30% by mass, and more preferably from 8% by mass to 20% by mass. When the concentration of the dispersion liquid of the vinyl resin fine particles is less than 5% by mass, a change in concentration of the organic solvent accompanied by the introduction of the dispersion liquid increases, causing insufficient attachment of resin fine particles. When concentration of the dispersion liquid of the vinyl resin fine particles is more than 30% by mass, this is preferably avoided because resin fine particles are likely to be localized in the core particle dispersion liquid, resulting nonuniform attachment of resin fine particles.

The reason that the vinyl resin fine particles are attached to core particles with sufficiently high strength by the method of the present invention is considered as follows. The core particles are freely deformable when vinyl resin fine particles are attached to liquid droplets of the core particles, and thus a contact surface between each liquid droplet with an interface of each vinyl resin fine particle is sufficiently formed, and vinyl resin fine particles are swollen or dissolved by the effect of an organic solvent, thereby the vinyl resin fine particles are easily bonded to the resin in the core particles.

Therefore, in this state, the organic solvent is necessary to be stably present in the system. More specifically, the amount of the organic solvent (present in the core particle dispersion liquid) is preferably from 50 parts by mass to 150 parts by mass, and more preferably from 70 parts by mass to 125 parts by mass to 100 parts by mass of the solid content of the resin, colorant, if necessary, a releasing agent and a charge controlling agent. When the amount of the organic solvent is more than 150 parts by mass, it is unfavorable because the amount of colored resin particles obtainable in one production process is reduced, causing low production efficiency, and the dispersion stability decreases, causing difficult in stable production of the colored resin particles.

The temperature at which the vinyl resin fine particles are attached to the core particles is 10° C. to 60° C., and more preferably 20° C. to 45° C. When the temperature is higher than 60° C., the energy necessary for production is increased and thus an increase in production environmental impact is caused. In addition, vinyl resin fine particles having a low acid value may be present on surfaces of liquid droplets, possibly causing unstable dispersion and occurrence of coarse particles. In contrast, when the temperature is lower than 10° C., unfavorably, the viscosity of the dispersion increases, causing insufficient attachment of the vinyl resin fine particles.

(Desolvation Step)

To remove the organic solvent from the resulting colored resin dispersion in the resin fine particle-attaching step, a method can be employed in which the temperature of the system is increased while the entire system being stirred, and the organic solvent in liquid droplets is completely evaporated and removed from the system.

In addition, the resulting colored resin dispersion is sprayed in a dry atmosphere while being stirred, so that the organic solvent in liquid droplets can be completely removed. Besides the above methods, the colored resin dispersion may be depressurized while being stirred to thereby evaporate and remove the organic solvent. The latter two methods may be combined with the first method.

As the dry atmosphere in which the colored resin dispersion is sprayed, gases such as a gas obtained by heating air, nitrogen, carbon gas, combustion gas, and in particular, various air streams heated to a temperature higher than the boiling point of the highest boiling point of a solvent used are generally used. Sufficiently colored resin particles with high quality can be obtained with a short period of time using a spray drier, belt drier, rotary kiln.

<Aging Step>

In the production of a dispersion liquid of the colored resin particles, when a modified resin having an isocyanate group in its terminal is added to the dispersion liquid, an aging step may be employed to accelerate a chain-extending/crosslinking reaction of the isocyanate. The aging time is typically from 10 minutes to 40 hours, and preferably from 2 hours to 24 hours. The reaction temperature is typically 0° C. to 65° C., and more preferably 35° C. to 50° C.

<Washing Step>

Since the dispersion liquid of the colored resin particles obtained by the above method contains secondary materials such as a dispersant, e.g. a surfactant, as well as the colored resin particles, the dispersion liquid is washed so as to take out the colored resin particles. A method for washing the colored resin particles is not particularly limited, and examples thereof include a centrifugation method, filtration under reduced pressure, and a filter press method. By any of these methods, a cake of the colored resin particles can be obtained. In the case where the dispersion liquid cannot be sufficiently washed by one operation, the resultant cake is dispersed in an aqueous solvent again so as to form slurry, and then the process of taking out the colored resin particles by any of these methods may be repeated. When the washing is performed by the filtration under reduced pressure or filter press method, an aqueous solvent is penetrated through the cake, and then secondary materials contained in the colored resin particles may be removed through washing. As the aqueous solvent used for the washing, water or mixed solvent obtained by mixing water with alcohol, such as methanol, ethanol, or the like is used. From the standpoint of cost, and an environmental load such as effluent treatment, water is preferably used.

<Drying Step>

Since washed colored resin particles contain large amount of the aqueous medium, the aqueous medium is removed by washing so as to obtain the colored reins particles alone. The drying method can be performed by using drying machine. Examples thereof include a spray dryer, vacuum freeze dryer, vacuum dryer, static shelf dryer, mobile shelf dryer, fluid bed dryer, rotary dryer and stirring dryer. The colored resin particles are preferably dried until each of the particles finally contains less than 1% by mass of water. In addition, when dried colored resin particles are in a soft aggregated state and inconvenient in practical use, the particles may be broken using a device such as a jet mill, a HENSCHEL MIXER, a super mixer, a coffee mill, an Oster blender, a food processor, to resolve the soft aggregation.

FIG. 1 shows a schematic construction of an image forming apparatus used in the present invention.

An image forming apparatus 1 includes an intermediate transfer belt 51 at a substantially center thereof. The intermediate transfer belt 51 is formed of a heat resistance material, such as polyimide, polyamide or the like, and is an endless belt formed of a base adjusted to have a medium resistance. The intermediate transfer belt 51 is stretched around four rollers 531, 532, 533, 534 so that they support the intermediate transfer belt 51, and the intermediate transfer belt 51 is driven to rotate. Under the intermediate transfer belt 51, four image forming units respectively corresponding to yellow (Y), cyan (C), magenta (M) and black (K) are aligned along a surface of the intermediate transfer belt 51.

Figure 2:
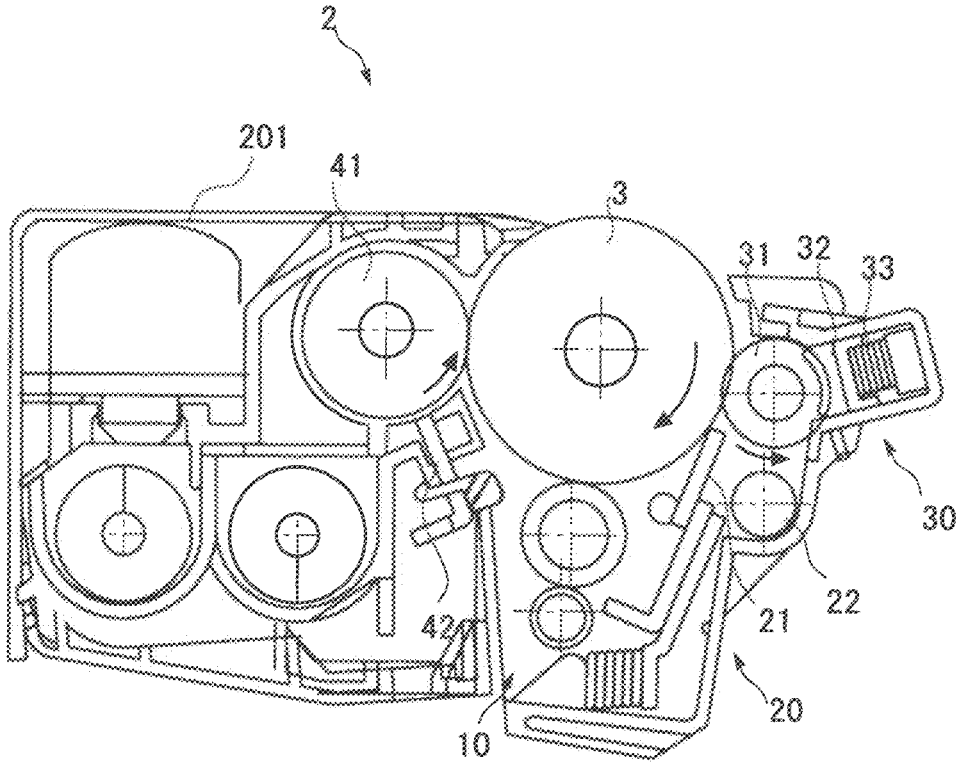
FIG. 2 shows an enlarged cross sectional view of one of four image forming units.

FIG. 2 is an enlarged cross sectional view showing one of the four image forming units. Since all image forming units have the same structures, in FIG. 2, Y, C, M, K for indicating respective colors are omitted. The image forming units respectively have photoconductors 3, and around each photoconductor 3 provided with a charging roller configured to apply charge to a surface of the photoconductor 3, a developing unit configured to develop a latent image formed on the surface of the photoconductor 3 using a toner of each color so as to form a toner image (visible image), the developing unit including a developing sleeve 41 and a regulation member 42, a brush roller 31 for applying a lubricant 32 onto the surface of the photoconductor 3, a lubricant applying unit 30 equipped with a lubricant applying blade for leveling a lubricant applied onto the surface of the photoconductor 3 using the brush roller 31, a cleaning unit 20 equipped with a cleaning blade 21 for cleaning the surface of the photoconductor 3 from which a toner image has been transferred, to thereby form one process cartridge 2 as shown in FIG. 2. Here, the process cartridge 2 as the image forming unit includes the photoconductor 3 and at least any one of the charging unit 10, the developing unit, the cleaning unit 20 and the lubricant applying unit 30 are integrally supported, and detachably attached to the image forming apparatus 1.

Moreover, under each of the four process cartridges 2, an exposing unit 4 is provided, and the exposing unit 4 is configured to expose the charged surface of the photoconductor 3 based on an image datum of each color so as to form a latent image.

A primary transfer roller 52 configured to primarily transfer a toner image formed on the photoconductor 3 onto the intermediate transfer belt 51 is provided in a position opposite to each photoconductor 3 via the intermediate transfer belt 51. The primary transfer roller 52 is connected to an electric source (not shown), and a predetermined voltage is applied thereto.

The outer surface of the intermediate transfer belt 51 is brought into press-contact with a secondary transfer roller 54 at a portion supported by the support roller 532. The secondary transfer roller 54 is connected to an electric source (not shown), and a predetermined voltage is applied thereto. A contact portion of the secondary transfer roller 54 with the intermediate transfer belt 51 is a secondary transfer portion, where a toner image on the intermediate transfer belt 51 is transferred onto a recording medium.

At a portion of the outer surface of the intermediate transfer belt 51 supported by the support roller 531, an intermediate transfer belt cleaning unit for cleaning the surface of the intermediate transfer belt 51 after secondary transfer is provided.

Above the secondary transfer portion, a fixing unit 70 configured to semipermanently fix the toner image on the recording medium is provided. The fixing unit 70 is constituted with a fixing roller 71 and a pressure roller 72 having a halogen heater inside and provided so as to press-contact with the fixing unit 70. Moreover, instead of the fixing roller 71, an endless fixing belt stretched around a heating roller containing a halogen roller inside and a fixing roller, may be provided (not shown).

Under the image forming apparatus, a paper feeding unit 60 configured to mount a recording medium thereon and eject the recording medium toward the secondary transfer portion, is provided. In FIG. 1, 31Y, 31C, 31M, and 31K denote toner supply units.

EXAMPLES

Hereinafter, the present invention will be further described in detail with reference to Examples, however, the following Examples shall not be construed as limiting the scope of the present invention. It should be noted that in the following examples, the unit "part(s) means "part(s) by mass" and the unit "%" means "% by mass" unless otherwise specified.

<Measurement of Volume Average Particle Diameter of Colored Resin Particles>

The volume average particle diameter of colored resin particles was measured by the Coulter Counter method. Examples of measurement devices of the volume average particle diameter include COULTER COUNTER TA-II, COULTER MULTISIZER II, and COULTER MULTISIZER III (all manufactured by Beckman Coulter, Inc.). The measurement method of the volume average particle diameter of cored resin particles is described as follows.

First, 0.1 mL to 5 mL of a surfactant (alkylbenzene sulfonic acid salt) was added as a dispersant in 100 mL to 150 mL of an electrolyte solution. Here, as the electrolyte solution, a 1% NaCl aqueous solution prepared using primary sodium chloride, ISOTON-II (manufactured by Beckman Coulter, Inc.) was used. Next, 2 mg to 20 mg of a measurement sample was added to the electrolyte solution. The electrolyte solution, in which the sample was suspended, was dispersed using an ultrasonic dispersing machine for about 1 minute to about 3 minutes to prepare a toner suspension liquid. The volume and the number of toner particles or toner were measured using the above measurement device with an aperture of 100 μm to determine a volume average particle size distribution and a number average particle size distribution of the toner. From the obtained distributions, a volume average particle diameter and number average particle diameter of the toner could be obtained.

In the measurement, the following 13 channels were used to measure particles having diameters of 2.00 μm or greater and smaller than 40.30 μm; a channel having a diameter of 2.00 μm or greater and smaller than 2.52 μm, a channel having a diameter of 2.52 μm or greater and smaller than 3.17 μm; a channel having a diameter of 3.17 μm or greater and smaller than 4.00 μm; a channel having a diameter of 4.00 or greater and smaller than 5.04 μm; a channel having a diameter of 5.04 μm or greater and smaller than 6.35 μm; a channel having a diameter of 6.35 μm or greater and smaller than 8.00 μm; a channel having a diameter of 8.00 μm or greater and smaller than 10.08 μm; a channel having a diameter of 10.08 μm or greater and smaller than 12.70 μm; a channel having a diameter of 12.70 μm or greater and smaller than 16.00 μm; a channel having a diameter of 16.00 μm or greater and smaller than 20.20 μm; a channel having a diameter of 20.20 μm or greater and smaller than 25.40 μm; a channel having a diameter of 25.40 μm or greater and smaller than 32.00 μm; and a channel having a diameter of 32.00 μm or greater and smaller than 40.30 μm.

<Measurement of Average Particle Diameter of Vinyl Resin Fine Particles>

The average particle diameter of the resin fine particles was measured using UPA-150EX (manufactured by NIKKISO Co., Ltd.).

<Measurement of Average Molecular Weight (GPC)>

The molecular weight of the resin was measured by Gel Permeation Chromatography (GPC) under the following conditions:

Device: GPC-150C (manufactured by Waters Instruments, Inc.)

Column: KF801 to KF807 (manufactured by SHOWA DENKO K.K.)

Temperature: 40° C.

Solvent: THF (tetrahydrofuran)

Rate of flow: 1.0 mL/min

Sample: 0.1 mL of a sample having a concentration of 0.05% to 0.6% was injected into the column.

Based on a molecular weight distribution of the resin measured under the above conditions, a number average molecular weight and a weight average molecular weight of the resin were calculated from a molecular weight calibration curve created using monodispersed polystyrene provided as standard samples. As the standard polystyrene samples, Nos. S-7300, S-210, S-390, S-875, S-1980, S-10.9, S-629, S-3.0, S-0.580 of Shodex Standard (available from Showa Denko K.K.) were used. As the detector, an RI (refractive index) detector was used.

<Measurement (DSC) of Endothermic Peak and Glass Transition Temperature (Tg)>

As a device for measuring the endothermic peak and Tg of a sample, a TG-DSC system, TAS-100 (manufactured by Rigaku Corporation) was used.

First, about 10 mg of a sample was placed in an aluminum-sample container, the container was mounted on a holder unit of the TG-DSC system and then set in an electric oven. The sample was heated from room temperature to 150° C. at a temperature increase rate of 10° C./min, left standing at 150° C. for 10 minutes, and then cooled to 0° C. and left standing for 10 minutes. The sample was heated again under a nitrogen atmosphere to 150° C. at a temperature increase rate of 10° C./min to thereby perform the DSC measurement. Using the analysis system in the TAS-100 system, the Tg was calculated from a tangent point between an endothermic curve obtained near Tg and the base line.

Moreover, the minimum point of the endothermic peak in temperature is defined as an endothermic peak temperature. In the present invention, "a sharp endothermic peak" refers to 40 J/g or more of an endotherm at the endothermic peak, and an enthalpy relaxation of a glass transition temperature is not taken as "a sharp endothermic peak".

<Measurement of Acid Value>

The acid value of the resin was measured according to JIS K1557-1970. The details of the measurement method is described below.

About 2 g of a pulverized product of a resin sample was accurately weighed (W(g)).

The resin sample was placed in a 200 mL-Erlenmeyer flask, 100 mL of a mixture solution of toluene/methanol (2:1) was added thereinto and dissolved for 5 hours, and then a phenol phthalein solution was added as an indicator into the solution.

The solution was titrated with a 0.1N potassium hydroxide alcohol solution using a burette. The amount of the KOH solution at this time was defined as S (mL). The KOH solution was subjected to a blank test, and the amount of the KOH solution at this time was defined as B (mL).

The acid value of the resin sample was calculated by the following equation:

Acid Value=[(S−B)×f×5.61]/W (f: factor of KOH solution)<

<Measurement of Hydroxyl Value>

A resin sample was weighed in a 100 mL recovery flask and 5 mL (accurately weighed) of an acetylated reagent was added thereto. Subsequently, the recovery flask was heated by dipping in a bath heated at 100° C.±5° C. One hour to two hours later, the flask was taken out from the bath, left standing to cool, and then ion exchanged water was added thereto. Thereafter, the flask was shaken to decompose acetic anhydride.

Further, to completely decompose the acetic anhydride, the flask was heated again in the bath for 10 minutes or longer and then left standing to cool. Thereafter, the wall of the flask was washed thoroughly with an organic solvent.

This solution was subjected to a potentiometric titration with a N/2 potassium hydroxide ethyl alcohol solution using glass electrodes to thereby determine a hydroxyl value of the resin (in accordance with JIS K0070-1966).

<Measurement of Solid Content Concentration>

The solid content concentration of an oil phase was measured in the following procedure.

On an aluminum pan (about 1 g to about 3 g, the mass had been accurately weighed in advance), about 2 g of the oil phase was placed within 30 seconds after weighing, and the mass of the oil phase placed on the aluminum pan was accurately weighed. This aluminum pan was put in an oven heated at 150° C. for 1 hour to evaporate the solvent. Thereafter, the aluminum pan was taken out from the oven and left standing to cool, followed by measuring the mass of the total mass of the aluminum pan and the solid content of the oil phase with an electronic balance. The mass of the aluminum pan was subtracted from the total mass of the aluminum pan and the solid content of the oil phase to calculate a mass of the solid content of the oil phase. The mass of the solid content of the oil phase was divided by the mass of the oil phase to calculate a solid content concentration of the oil phase. A ratio of the amount of the solvent to the solid content of the oil phase was a value obtained by dividing the mass of the solvent (i.e. a value obtained by subtracting the mass of the solid content of the oil phase from the mass of the oil phase) by the mass of the solid content of the oil phase.

Synthesis Example 1

Synthesis of Crystalline Polyester Resin 1

Under a nitrogen atmosphere, 294 parts of adipic acid, 248 parts of ethylene glycol, and 0.12 parts of dibutyltin oxide were mixed and stirred at 180° C. for 6 hours. Next, the obtained mixture was stirred under reduced pressure for 4 hours to thereby synthesize Crystalline Polyester Resin 1. Crystalline Polyester Resin 1 had a weight average molecular weight Mw of 20,200 and a number average molecular weight Mn of 7,900.

Using a differential scanning calorimeter (DSC) the endothermic peak of the Crystalline Polyester Resin 1 was measured to have a sharp endothermic peak. The temperature of the peak top was 47° C.

Synthesis Example 2

Synthesis of Crystalline Polyester Resin 2

Under a nitrogen atmosphere, 146 parts of adipic acid, 175 parts of 1,10-decanediol, and 0.12 parts of dibutyltin oxide were mixed and stirred at 180° C. for 6 hours. Next, the obtained mixture was stirred under reduced pressure for 4 hours to thereby synthesize Crystalline Polyester Resin 2.

Crystalline Polyester Resin 2 had a weight average molecular weight Mw of 16,700 and a number average molecular weight Mn of 6,500.

Using the differential scanning calorimeter (DSC) the endothermic peak of the Crystalline Polyester Resin 2 was measured to have a sharp endothermic peak. The temperature of the peak top was 69° C.

Synthesis Example 3

Synthesis of Crystalline Polyester Resin 3

Under a nitrogen atmosphere, 232 parts of fumaric acid, 238 parts of 1,6-hexanediol, and 0.12 parts of dibutyltin oxide were mixed and stirred at 180° C. for 6 hours. Next, the obtained mixture was stirred under reduced pressure for 4 hours to thereby synthesize Crystalline Polyester Resin 3. Crystalline Polyester Resin 3 had a weight average molecular weight Mw of 22,200 and a number average molecular weight Mn of 7,000.

Using the differential scanning calorimeter (DSC) the endothermic peak of the Crystalline Polyester Resin 3 was measured to have a sharp endothermic peak. The temperature of the peak top was 117° C.

Synthesis Example 4

Synthesis of Crystalline Polyester Resin 4

Under a nitrogen atmosphere, 192 parts of dimethyl terephthalate, 166 parts of 1,10-decanediol, and 0.12 parts of dibutyltin oxide were mixed and stirred at 180° C. for 6 hours. Next, the obtained mixture was stirred under reduced pressure for 4 hours to thereby synthesize Crystalline Polyester Resin 4. Crystalline Polyester Resin 4 had a weight average molecular weight Mw of 27,500 and a number average molecular weight Mn of 7,400.

The endothermic peak of the Crystalline Polyester Resin 4 was measured using the differential scanning calorimeter (DSC), and had a sharp endothermic peak. The temperature of the peak top was 137° C.

Synthesis Example 5

Synthesis of Crystalline Polyester Resin 5

Under a nitrogen atmosphere, 232 parts of fumaric acid, 201 parts of 1,6-hexanediol, 27 parts of 1,4-butanediol, and 0.12 parts of dibutyltin oxide were mixed and stirred at 180° C. for 6 hours. Next, the obtained mixture was stirred under reduced pressure for 4 hours to thereby synthesize Crystalline Polyester Resin 5. Crystalline Polyester Resin 5 had a weight average molecular weight Mw of 20,700 and a number average molecular weight Mn of 6,400.

Using the differential scanning calorimeter (DSC) the endothermic peak of the Crystalline Polyester Resin 5 was measured to have a sharp endothermic peak. The temperature of the peak top was 86° C.

Synthesis Example 6

Synthesis of Crystalline Polyester Resin 6

Under a nitrogen atmosphere, 240 parts of succinic acid, 205 parts of 1,5-pentanediol, 0.70 parts of dibutyltin oxide were mixed and stirred at 180° C. for 6 hours. Next, the obtained mixture was stirred under reduced pressure for 4 hours to thereby synthesize Crystalline Polyester Resin 6. Crystalline Polyester Resin 6 had a weight average molecular weight Mw of 22,100 and a number average molecular weight Mn of 6,200.

Using the differential scanning calorimeter (DSC) the endothermic peak of the Crystalline Polyester Resin 6 was measured to have a sharp endothermic peak. The temperature of the peak top was 33° C.

Synthesis Example 7

Synthesis of Polyester Resin 1

Into a reaction vessel equipped with a condenser, a stirrer and a nitrogen inlet tube, 229 parts of an ethylene oxide (2 mol) adduct of bisphenol A, 529 parts of a propylene oxide (2 mol) adduct of bisphenol A, 208 parts of terephthalic acid, 46 parts of adipic acid and 2 parts of dibutyltin oxide were charged, and reacted under normal pressure at 230° C. for 8 hours. Next, the reaction system was reacted under reduced pressure of 1.3 kPa to 2.0 kPa (10 mmHg to 15 mmHg) for 5 hours, and then 44 parts of trimellitic anhydride was added to the reaction vessel and further reacted under normal pressure at 180° C. for 2 hours to thereby synthesize Polyester Resin 1.

Polyester Resin 1 had a number average molecular weight Mn of 2,500, a weight average molecular weight Mw of 6,700, a glass transition temperature of 43° C. and an acid value of 25 mgKOH/g.

Synthesis Example 8

Synthesis of Polyester Resin 2

Into a reaction vessel equipped with a condenser, a stirrer and a nitrogen inlet tube, 270 parts of an ethylene oxide (2 mol) adduct of bisphenol A, 497 parts of a propylene oxide (2 mol) adduct of bisphenol A, 110 parts of terephthalic acid, 102 parts of isophthalic acid, 44 parts of adipic acid and 2 parts of dibutyltin oxide were charged, and reacted under normal pressure at 230° C. for 9 hours. Next, the reaction system was reacted under reduced pressure of 1.3 kPa to 2.3 kPa (10 mmHg to 18 mmHg) for 7 hours, and then 40 parts of trimellitic anhydride was added to the reaction vessel and further reacted at 180° C. under normal pressure for 2 hours to thereby synthesize Polyester Resin 2.

Polyester Resin 2 had a number average molecular weight Mn of 3,000, a weight average molecular weight Mw of 8,600, a glass transition temperature of 49° C. and an acid value of 22 mgKOH/g.

Synthesis Example 9

Synthesis of Polyester Resin 3

Into a reaction vessel equipped with a condenser, a stirrer and a nitrogen inlet tube, 218 parts of an ethylene oxide (2 mol) adduct of bisphenol A, 460 parts of a propylene oxide (2 mol) adduct of bisphenol A, 140 parts of terephthalic acid, 145 parts of isophthalic acid, and 2 parts of dibutyltin oxide were charged, and reacted under normal pressure at 230° C. for 8 hours. Next, the reaction system was reacted under reduced pressure of 1.3 kPa to 2.3 kPa (10 mmHg to 18 mmHg) for 6 hours, and then 24 parts of trimellitic anhydride was added to the reaction vessel and further reacted under normal pressure at 180° C. for 2 hours to thereby synthesize Polyester Resin 3.

Polyester Resin 3 had a number average molecular weight Mn of 7,600, a weight average molecular weight Mw of 21,000, a glass transition temperature of 57° C. and an acid value of 15 mgKOH/g.

Synthesis Example 10

Synthesis of Prepolymer 1

Into a reaction vessel equipped with a condenser, a stirrer and a nitrogen inlet tube, 682 parts of an ethylene oxide (2 mol) adduct of bisphenol A, 81 parts of a propylene oxide (2 mol) adduct of bisphenol A, 283 parts of terephthalic acid, 22 parts of trimellitic anhydride, and 2 parts of dibutyltin oxide were charged, reacted under normal pressure at 230° C. for 8 hours, and further reacted under reduced pressure of 1.3 kPa to 2.0 kPa (10 mmHg to 15 mmHg) for 5 hours to thereby obtain Intermediate Polyester Resin 1.

Intermediate Polyester Resin 1 had a number average molecular weight Mn of 2,100, a weight average molecular weight Mw of 9,500, a glass transition temperature Tg of 55° C., an acid value of 0.5 mgKOH/g and a hydroxyl value of 49 mgKOH/g.

Next, into another reaction vessel equipped with a condenser, a stirrer and a nitrogen inlet tube, 411 parts of Intermediate Polyester Resin 1, 89 parts of isophoronediisocyanate and 500 parts of ethyl acetate were charged and reacted at 100° C. for 5 hours to thereby obtain Prepolymer 1. Prepolymer 1 had a free isocyanate content of 1.53%.

Production Example 1

Production of Dispersion Liquid 1 of Vinyl Resin Fine Particles

Into 254 parts of ion exchanged water, 0.4 parts of sodium dodecyl sulfate was added, and dissolved by heating at 70° C., to thereby obtain an aqueous medium. Separately, 85 parts of styrene monomer, 15 parts of Crystalline Polyester Resin 2, and 1.8 parts of n-octanethiol were stirred at 70° C. under a nitrogen atmosphere while heating, to thereby obtain a uniform monomer solution.

The obtained monomer solution was added to the aqueous medium, and while kept at 70° C., the medium was subjected to ultrasonic irradiation at 90 W to 110 W for 10 minutes using an ultrasonic homogenizer (VCX-750, manufactured by TOKYO RIKAKIKAI CO, LTD.), so as to disperse the monomer solution into the aqueous medium, to thereby obtain a dispersion solution. In midstream, the temperature of the solution was increased due to the ultrasonic irradiation, but it was adjusted to 65° C. to 75° C. using a water bath or the like.

The obtained dispersion solution was transferred to a reaction vessel equipped with a condenser, a stirrer and a nitrogen inlet tube, and kept at 70° C. while being stirred, and 1.1 parts of potassium persulfate dissolved in 44 parts of ion exchanged water was added to the dispersion solution so as to perform polymerization reaction for 180 minutes, followed by cooling, to thereby obtain Dispersion Liquid 1 of Vinyl Resin Fine Particles. Dispersion Liquid 1 of Vinyl Resin Fine Particles was white color and had a volume average particle diameter of 156 nm.

Production Example 2

Production of Dispersion Liquid 2 of Vinyl Resin Fine Particles

Dispersion Liquid 2 of Vinyl Resin Fine Particles was produced in the same manner as in Production Example 1, except that Crystalline Polyester Resin 2 was replaced with Crystalline Polyester Resin 3.

Production Example 3

Production of Dispersion Liquid 3 of Vinyl Resin Fine Particles

Dispersion Liquid 3 of Vinyl Resin Fine Particles was produced in the same manner as in Production Example 1, except that Crystalline Polyester Resin 2 was replaced with Crystalline Polyester Resin 1.

Production Example 4

Production of Dispersion Liquid 4 of Vinyl Resin Fine Particles

Dispersion Liquid 4 of Vinyl Resin Fine Particles was produced in the same manner as in Production Example 1, except that Crystalline Polyester Resin 2 was replaced with Crystalline Polyester Resin 4.

Production Example 5

Production of Dispersion Liquid 5 of Vinyl Resin Fine Particles

Dispersion Liquid 5 of Vinyl Resin Fine Particles was produced in the same manner as in Production Example 1, except that the composition of the monomer solution in Production Example 1 was changed to as follows: 75 parts of styrene monomer, 10 parts of butyl acrylate, 15 parts of Crystalline Polyester Resin 2, and 1.8 parts of n-octanethiol.

Production Example 6

Production of Dispersion Liquid 6 of Vinyl Resin Fine Particles

Dispersion Liquid 6 of Vinyl Resin Fine Particles was produced in the same manner as in Production Example 1, except that the composition of the monomer solution in Production Example 1 was changed to as follows: 92 parts of styrene monomer, 8 parts of Crystalline Polyester Resin 2, and 1.8 parts of n-octanethiol.

Production Example 7

Production of Dispersion Liquid 7 of Vinyl Resin Fine Particles

Dispersion Liquid 7 of Vinyl Resin Fine Particles was produced in the same manner as in Production Example 1, except that the composition of the monomer solution in Production Example 1 was changed to as follows: 55 parts of styrene monomer, 45 parts of Crystalline Polyester Resin 2, and 1.8 parts of n-octanethiol.

Production Example 8

Production of Dispersion Liquid 8 of Vinyl Resin Fine Particles

Dispersion Liquid 8 of Vinyl Resin Fine Particles was produced in the same manner as in Production Example 1, except that the composition of the monomer solution in Production Example 1 was changed to as follows: 45 parts of styrene monomer, 55 parts of Crystalline Polyester Resin 2, and 1.8 parts of n-octanethiol.

Production Example 9

Production of Dispersion Liquid 9 of Vinyl Resin Fine Particles

Dispersion Liquid 9 of Vinyl Resin Fine Particles was produced in the same manner as in Production Example 1, except that Crystalline Polyester Resin 2 was replaced with Crystalline Polyester Resin 5.

Production Example 10

Production of Dispersion Liquid 10 of Vinyl Resin Fine Particles

To a reaction vessel equipped with a condenser, a stirrer and a nitrogen inlet tube, 0.7 parts of sodium dodecyl sulfate, and 498 parts of ion exchanged water were charged, and dissolved together by stirring at 80° C. while being heated, followed by adding the mixture obtained by dissolving 2.6 parts of potassium persulfate in 104 parts of ion exchanged water therein. After 15 minutes, a monomer mixed liquid containing 200 parts of styrene monomer and 4.2 parts of n-octanethiol was added dropwise to the reaction vessel for 90 minutes, and followed by polymerization reaction for 60 minutes while the temperature was maintained at 80° C.

Thereafter, the resultant mixture was cooled to thereby produce white colored Dispersion Liquid 10 of Vinyl Resin Fine Particles.

Production Example 11

Production of Dispersion Liquid 11 of Vinyl Resin Fine Particles

Dispersion Liquid 11 of Vinyl Resin Fine Particles was produced in the same manner as in Production Example 1, except that Crystalline Polyester Resin 2 was replaced with Crystalline Polyester Resin 6.

Production of Masterbatch 1

A carbon black (REGAL 400R, manufactured by Cabot Corporation) (40 parts), 60 parts of Polyester Resin 1 and 30 parts of water were mixed by a HENSCHEL MIXER to obtain a mixture in which carbon black aggregates were dampened with water. This mixture was kneaded with a two-roll which the roll surface temperature was maintained at 130° C. for 45 minutes and then pulverized into particles of 1 mm in size using a pulverizer to thereby obtain Masterbatch 1.

Example 1

Preparation of Aqueous Phase

Ion exchanged water (970 parts), 40 parts of a 25% aqueous dispersion liquid of organic resin fine particles (sodium salt of sulfate of ethylene oxide adduct of a styrene-methacrylic acid-butyl acrylate-methacrylic acid copolymer) for dispersion stabilization, 95 parts of a 48.5% aqueous solution of sodium dodecyldiphenyl ether disulfonate, and 98 parts of ethyl acetate were mixed and stirred to obtain a mixture having a pH of 6.2. Then, a 10% sodium hydroxide aqueous solution was added dropwise into the mixture so as to have a pH 9.5, thereby obtaining Aqueous Phase 1.

<Production of Oil Phase>

Into a vessel equipped with a stirrer and a thermometer, 545 parts of Polyester Resin 1, 181 parts of paraffin wax (melting point: 74° C.) and 1,450 parts of ethyl acetate were charged, and the temperature thereof was increased to 80° C. while the mixture was stirred, and maintained at 80° C. for 5 hours, followed by cooling to 30° C. in 1 hour. Next, 500 parts of Masterbatch 1 and 100 parts of ethyl acetate were charged into the vessel and mixed for 1 hour to obtain Starting Material Solution 1.

Starting Material Solution 1 (1,500 parts) was transferred to a vessel, and the pigment and wax were dispersed with a bead mill (ULTRA VISCOMILL manufactured by Aimex Co., Ltd.) under the following conditions: a liquid feed rate of 1 kg/hr, disc circumferential speed of 6 m/sec, 0.5 mm-zirconia bead filled at 80% by volume, and three passes. Subsequently, 655 parts of a 65% ethyl acetate solution of Polyester Resin 1 was added to Starting Material Solution 1 and passed once through the bead mill under the conditions described above, to thereby obtain Pigment/Wax Dispersion Liquid 1. Ethyl acetate was added in the resulting Pigment/Wax Dispersion Liquid 1 so that the solid content thereof was prepared to be 50% at 130° C. for 30 minutes.

Pigment/Wax Dispersion Liquid 1 (976 parts) and 2.6 parts of isophoronediamine were mixed at 5,000 rpm for 1 minute using a TK homomixer (manufactured by Tokushu Kikai Kogyo Co. Ltd.), and then 88 parts of Prepolymer 1 was added thereto and mixed at 5,000 rpm for 1 minute using the TK homomixer (manufactured by Tokushu Kikai Kogyo Co., Ltd.) to obtain Oil Phase 1. In the above formulation, the solid content concentration of Oil Phase 1 was prepared to be 50% by mass and the amount of the ethyl acetate relative to the solid content was 100% by mass, but actually, the solid content of the resulting Oil Phase 1 was measured to be 52%, and the amount of ethyl acetate to the solid content was 92%.

<Production of Core Particles>

Aqueous Phase 1 (1,200 parts) was added to the resulting Oil Phase 1 and then mixed using a TK homomixer with the number of revolutions of the mixer being set to 8,000 rpm to 15,000 rpm for 2 minutes while the liquid temperature was controlled to be within the range of 20° C. to 23° C. by cooling in a water bath for the purpose of suppressing a temperature increase due to shearing heat caused by the mixer, and then stirred for 10 minutes while the number of revolutions of a Three-One Motor equipped with an anchor blade was controlled at 130 rpm to 350 rpm, to thereby obtain Core Particle Slurry 1 in which liquid droplets of the oil phase formed into core particles, were dispersed in the aqueous phase.

<Attachment of Resin Fine Particles>

A mixture obtained by mixing 106 parts of Dispersion Liquid 1 of Vinyl Resin Fine Particle and 71 parts of ion exchanged water (solid content concentration: 15%) was added dropwise into Core Particle Slurry 1 for 3 minutes while Core Particle Slurry 1 was stirred using a Three-One Motor equipped with an anchor blade with the number of revolutions thereof being set from 130 rpm to 350 rpm in a state where the liquid temperature was 22° C. After the dropping, the mixture was continuously stirred for 30 minutes while the number of revolutions was controlled at from 200 rpm to 450 rpm to obtain Composite Particle Slurry 1. Then, 1 mL of Composite Particle Slurry 1 was sampled and diluted to 10 mL, followed by centrifugal separation. As a result, the supernatant fluid was transparent.

<Desolvation>

Into a vessel equipped with a stirrer and a thermometer, the thus obtained Composite Particle Slurry 1 was charged, followed by desolvation at 30° C. for 8 hours while being stirred to thereby obtain Dispersion Slurry 1.

<Washing and Drying>

After Dispersion Slurry 1 (100 parts) was filtered under reduced pressure, washing and drying were performed as follows:

(1): Ion exchanged water (100 parts) was added to the resulting filter cake and mixed at 12,000 rpm for 10 minutes using a TK homomixer, followed by a filtration treatment.

(2): Ion exchanged water (900 parts) was added into the filter cake prepared in (1), mixed (at 12,000 rpm for 30 minutes) using the TK homomixer while applying ultrasonic vibration, and then filtered under reduced pressure. This treatment was repeated until the electric conductivity of the reslurry liquid became 10 μC/cm or lower.

(3): A 10% hydrochloric acid solution was added to the reslurry liquid prepared in (2) so that the pH of the reslurry liquid was 4, and then stirred using a Three-One Motor for 30 minutes, followed by a filtration treatment.

(4): Ion exchanged water (100 parts) was added to the filter cake prepared in (3) and mixed (at 12,000 rpm for 10 minutes) using the TK homomixer, followed by a filtration treatment. This treatment was repeated until the electric conductivity of the reslurry liquid became 10 μC/cm or lower, to thereby obtain Filter Cake 1.

Filter Cake 1 was dried with a circular air-drier at 45° C. for 48 hours and sieved with a mesh with openings of 75 μm, to thereby obtain Colored Resin Particles 1. Colored Resin Particles 1 had a volume average particle diameter Dv of 6.1 μm, and Dv/Dn of 1.14.

Next, 100 parts of Colored Resin Particles 1 (toner base), 0.5 parts of hydrophobic silica and 0.5 parts of hydrophobized titanium oxide were mixed using a HENSCHEL MIXER, to thereby obtain Toner 1.

Next, the properties of the resultant Toner 1 were evaluated as follows. The results are shown in Table 1.

<Chargeability (Background Smear)>

A black (Bk) cartridge in an image forming apparatus (IPSIO SP C220, manufactured by Ricoh Company, Ltd.) was supplied with a toner, and an image was formed on a blank sheet and printed out. Then, the blank sheet and a photoconductor were visually observed, and evaluated based on the following evaluation criteria.

Evaluation Criteria

A: A toner adhesion was not observed both on the blank sheet and the photoconductor.

B: A toner adhesion on the blank sheet was not observed, but a toner adhesion on the photoconductor was slightly observed when it was obliquely observed.

C: A toner adhesion on the blank sheet was slightly observed when it was obliquely observed.

D: A toner adhesion on the blank sheet was clearly observed.

<Fixability (Low Temperature Stability)>

An image forming apparatus IPSIO SP C220 (manufactured by Ricoh Company, Ltd.), which had been modified, was supplied with a toner, and controlled so that the toner adhesion amount became 10 g/m$^2$, and then an unfixed solid image having a size of 50 mm square was printed on 19 paper, Type 6200 (short grain, manufactured by Ricoh Company, Ltd.).

Next, using the fixing unit which had been modified, the system speed was set at 280 mm/sec, and the prepared unfixed solid images were passed through the fixing unit so as to fix each image on the paper. The fixing temperature was changed from 120° C. to 200° C. at regular intervals of 5° C. The paper was folded with facing the surface having the fixed image inside, and unfolded. Thereafter, the paper was lightly rubbed with an eraser. The lower-limit fixing temperature of the toner was defined as the lowest fixing temperature at which a fold line was not erased. The low temperature fixability of the toners was evaluated based on the following evaluation criteria.

Evaluation Criteria

A: The lower-limit fixing temperature was lower than 130° C.

B: The lower-limit fixing temperature was from 130° C. or higher to lower than 140° C.

C: The lower-limit fixing temperature was from 140° C. or higher to lower than 150° C.

D: The lower-limit fixing temperature was 150° C. or higher.

<Image Gloss after Fixation>

A 60 degree gloss of an image after fixation was measured using a gloss meter (VG 7000, manufactured by NIPPON DENSHOKU INDUSTRIES CO., LTD.). As the fixing temperature increased, the gloss gradually became high. However, the gloss began to lower at a certain temperature, and image quality was degraded. The temperature immediately before the gloss began to lower was defined as the upper-limit fixing temperature, and the image gloss after fixation was evaluated based on the following evaluation criteria.

Evaluation Criteria

A: The upper-limit fixing temperature was 200° C. or higher.

B: The upper-limit fixing temperature was 190° C. or higher to less than 200° C.

C: The upper-limit fixing temperature was 180° C. or higher to less than 190° C.

D: The upper-limit fixing temperature was less than 180° C.

<Heat Resistant Storage Stability>

The penetration was measured by charging 25 g of toner sample into a 50 mL glass container, leaving the glass container in a thermostat bath at 55° C. for 24 hours, followed by cooling the toner to 24° C., and then a penetration test (JIS K2235-1991) of the toner was performed. The penetration was evaluated based on the following evaluation criteria. Note that, the higher the penetration was, the more excellent heat resistant storage stability the toner had. In the case where the penetration was less than 10 mm, a problem was likely to occur.

[Evaluation Criteria]

A: 20 mm or more

B: 15 mm or more to less than 20 mm

C: 10 mm or more to less than 15 mm

D: less than 10 mm

Examples 2 to 7

Toners 2 to 7 were produced in the same manner as in Example 1, except that Dispersion Liquid 1 of Vinyl Resin Fine Particles of Example 1 was respectively replaced with Dispersion Liquids of Vinyl Resin Fine Particles shown in Table 1. The resultant toners 2 to 7 were evaluated in the same manner as in Example 1. The results are shown in Table 1.

Example 8

Preparation of Aqueous Phase

Ion exchanged water (970 parts), 29 parts of a 25% aqueous dispersion liquid of organic resin fine particles (sodium salt of sulfate of ethylene oxide adduct of a styrene-methacrylic acid-butyl acrylate-methacrylic acid copolymer) for dispersion stabilization, 95 parts of a 48.5% aqueous solution of sodium dodecyldiphenyl ether disulfonate, and 98 parts of ethyl acetate were mixed and stirred to obtain a mixture having a pH of 6.2. Then, a 10% sodium hydroxide aqueous solution was added dropwise into the mixture so as to have a pH of 9.1, to thereby obtain Aqueous Phase 10.

<Production of Pigment/Wax Dispersion Liquid (Oil Phase)>

Into a vessel equipped with a stirrer and a thermometer, 175 parts of Polyester Resin 2, 430 parts of Polyester Resin 3, 153 parts of paraffin wax (melting point: 74° C.) and 1,450 parts of ethyl acetate were charged, and the temperature thereof was increased to 80° C. while the mixture was stirred, and maintained at 80° C. for 5 hours, followed by cooling to 30° C. for 1 hour. Next, 410 parts of Masterbatch 1 and 100 parts of ethyl acetate were charged into the vessel and mixed for 1 hour to obtain Starting Material Solution 10.

Starting Material Solution 10 (1,500 parts) was transferred to a vessel, and the pigment and wax were dispersed with a bead mill (ULTRA VISCOMILL manufactured by Aimex Co., Ltd.) under the following conditions: a liquid feed rate of 1 kg/hr, disc circumferential speed of 6 m/sec, 0.5 mm-zirconia bead filled at 80% by volume, and three passes. Subsequently, 470 parts of a 70% ethyl acetate solution of Polyester Resin 2, 250 parts of a 55% ethyl acetate solution of Polyester Resin 3 and 95 parts of ethyl acetate were added to Starting Material Solution 10 and passed once through the bead mill under the conditions described above, to thereby obtain Oil Phase 10.

The solid content of the resulting Oil Phase 10 was measured to be 49.3%, and the amount of ethyl acetate to the solid content was 103%.

<Production of Core Particle>

Oil Phase 10 (976 parts) was added to 1,200 parts of Aqueous Phase 10 and mixed using the TK homomixer for 2 minutes while the number of revolutions was controlled at from 8,000 rpm to 15,000 rpm to thereby obtain Core Particle Emulsion Slurry 10.

<Attachment of Resin Fine Particles>

A mixture (solid content concentration: 15%) containing 106 parts of Dispersion Liquid 1 of Vinyl Resin Fine Particles and 71 parts of ion exchanged water was added dropwise into Core Particle Emulsion Slurry 10 for 3 minutes while Core Particle Emulsion Slurry 10 being stirred using a Three-One Motor equipped with an anchor blade with the number of revolutions thereof being set from 130 rpm to 350 rpm in a state where the liquid temperature was 22° C. After the dropping, the mixture was continuously stirred for 30 minutes while the number of revolutions was controlled at from 200 rpm to 450 rpm to thereby obtain Composite Particle Slurry 10. Then, 1 mL of Composite Particle Slurry 10 was sampled and diluted to 10 mL, followed by centrifugal separation. As a result, the supernatant fluid was transparent.

<Desolvation>

Into a vessel equipped with a stirrer and a thermometer, the thus obtained Composite Particle Slurry 10 was charged, followed by desolvation at 30° C. for 8 hours while being stirred, to thereby obtain Dispersion Slurry 10. A small amount of Dispersion Slurry 10 was placed on a slide glass, covered with cover glasses, and then the appearance thereof was observed with an optical microscope (magnification: 200), and then colored particles uniform in size were observed.

<Washing and Drying>

After Dispersion Slurry 10 (100 parts) was filtered under reduced pressure, washing and drying were performed as follows:

(1): Ion exchanged water (100 parts) was added to the resulting filter cake and mixed (at 12,000 rpm for 10 minutes) using a TK homomixer, followed by a filtration treatment.

(2): Ion exchanged water (900 parts) was added into the filter cake prepared in (1), mixed (at 12,000 rpm for 30 minutes) using the TK homomixer while applying ultrasonic vibration, and then filtered under reduced pressure. This treatment was repeated until the electric conductivity of the reslurry liquid became 10 μC/cm or lower.

(3): A 10% hydrochloric acid solution was added to the reslurry liquid prepared in (2) so that the pH of the reslurry liquid was 4, and then stirred using a Three-One Motor for 30 minutes, followed by a filtration treatment.

(4): Ion exchanged water (100 parts) was added to the filter cake prepared in (3) and mixed (at 12,000 rpm for 10 minutes) using the TK homomixer, followed by a filtration treatment. This treatment was repeated until the electric conductivity of the reslurry liquid became 10 μC/cm or lower, to thereby obtain Filter Cake 10.

Filter Cake 10 was dried with a circular air-drier at 45° C. for 48 hours and sieved with a mesh with openings of 75 μm, to thereby obtain Colored Resin Particles 10. Colored Resin Particles 10 had a volume average particle diameter Dv of 6.2 μm, and Dv/Dn of 1.13.

Next, 100 parts of Colored Resin Particles 10 (toner base), 0.5 parts of hydrophobic silica and 0.5 parts of hydrophobized titanium oxide were mixed using a HENSCHEL MIXER, to thereby obtain Toner 10.

Next, the properties of the resultant Toner 10 were evaluated in the same manner as in Example 1. The results are shown in Table 1.

Comparative Example 1

Toner 101 was produced in the same manner as in Example 1, except that Dispersion Liquid 1 of Vinyl Resin Fine Particles was replaced with Dispersion Liquid 10 of Vinyl Resin Fine Particles.

Comparative Example 2

Toner 102 was produced in the same manner as in Example 8, except that Dispersion Liquid 1 of Vinyl Resin Fine Particles was replaced with Dispersion Liquid 10 of Vinyl Resin Fine Particles.

Comparative Example 3

Toner 103 was produced in the same manner as in Example 1, except that Dispersion Liquid 1 of Vinyl Resin Fine Particles was replaced with Dispersion Liquid 2 of Vinyl Resin Fine Particles.

Comparative Example 4

Toner 104 was produced in the same manner as in Example 1, except that Dispersion Liquid 1 of Vinyl Resin Fine Particles was replaced with Dispersion Liquid 4 of Vinyl Resin Fine Particles.

Comparative Example 5

Crystalline Polyester Resin 1 (20 parts) was added to 100 parts of ethyl acetate, and stirred at 70° C. for 30 minutes to produce a transparent ethyl acetate solution of crystalline polyester resin. This solution was rapidly cooled to precipitate crystals, then dispersed using a sand mill for 10 hours while being sufficiently cooled, so as to form fine particles. The dispersion liquid was dried in vacuum at 28° C., to thereby obtain fine particles of Crystalline Polyester Resin 1.

Next, into a reaction vessel equipped with a stirrer and a thermometer, 276 parts of resultant fine particles of Crystalline Polyester Resin 1 was charged, 683 parts of ion exchanged water, and 11 parts of a sodium salt of sulfate of an ethylene oxide adduct of methacrylic acid (ELEMINOL RS-30, manufactured by Sanyo Chemical Industries, Ltd.) were added and stirred at 10° C. to 20° C. for 30 minutes at 400 rpm.

Into the same reaction vessel, 200 parts of styrene, and 1 part of ammonium persulfate were charged, and stirred at 400 rpm for 15 minutes, to thereby obtain a white colored emulsion. It was considered that at least the monomer was dispersed and present as liquid droplet particles in the system. However, when this was heated to 75° C., the emulsion was started to phase separate during heating, and the particle state could not be maintained.

Comparative Example 6

Toner 106 was produced in the same manner as in Example 1, except that Dispersion Liquid 1 of Vinyl Resin Fine Particles was replaced with Dispersion Liquid 11 of Vinyl Resin Fine Particles.

What is claimed is:

1. A toner comprising:

core particles each containing at least a resin A having a polyester skeleton and a colorant; and vinyl resin fine particles each of which encapsulates a resin B having at least a polyester skeleton and an endothermic peak measured by differential scanning calorimeter (DSC) at 40° C. to 110° C., wherein the vinyl resin fine particles are attached onto each of the core particles.

2. The toner according to claim 1, wherein the resin B comprises a crystalline polyester resin.

3. The toner according to claim 1, wherein the ratio of the resin B in the vinyl resin fine particles is 10% by mass to 50% by mass.

4. The toner according to claim 1, wherein each of the vinyl resin fine particles is formed of a vinyl resin, which is a copolymer of a styrene monomer and another monomer, and wherein the ratio of the styrene monomer in the monomers is 80% by mass or more.

5. The toner according to claim 1, wherein each of the vinyl resin fine particles is formed of a vinyl resin, which is polystyrene.

6. A method for producing a toner, comprising:

dispersing or dissolving at least a resin A having a polyester skeleton and a colorant in an organic solvent so as to prepare an oil phase;

preparing an aqueous phase containing at least a surfactant in an aqueous medium;

dispersing the oil phase in the aqueous phase so as to prepare a dispersion liquid of core particles in which the core particles formed of the oil phase are dispersed;

dispersing vinyl resin fine particles encapsulating a resin B having at least a polyester skeleton and an endothermic peak measured by differential scanning calorimeter (DSC) at 40° C. to 110° C. in an aqueous medium, so as to prepare a dispersion liquid of the vinyl resin fine particles; and

TABLE 1

| | Vinyl resin fine particles | | | | | | | Evaluation results | | | |
|---|---|---|---|---|---|---|---|---|---|---|---|
| | Number of dispersion liquid of vinyl resin fine particles | Composition (% by mass) | | | Crystalline polyester resin | | | Charge-ability/ Background smear | Low temperature fixability | Image gloss | Heat resistant storage stability |
| | | Styrene | Butyl acrylate | Crystalline polyester resin | No. | Crystallinity | Endothermic peak (° C.) | | | | |
| Ex. 1 | 1 | 85 | 0 | 15 | 2 | Present | 69 | A | A | A | A |
| Ex. 2 | 9 | 85 | 0 | 15 | 5 | Present | 86 | A | B | A | A |
| Ex. 3 | 3 | 85 | 0 | 15 | 1 | Present | 47 | A | A | A | B |
| Ex. 4 | 5 | 75 | 10 | 15 | 2 | Present | 69 | B | A | A | A |
| Ex. 5 | 6 | 92 | 0 | 8 | 2 | Present | 69 | A | B | A | A |
| Ex. 6 | 7 | 55 | 0 | 45 | 2 | Present | 69 | B | A | A | A |
| Ex. 7 | 8 | 45 | 0 | 55 | 2 | Present | 69 | C | A | B | B |
| Ex. 8 | 1 | 85 | 0 | 15 | 2 | Present | 69 | A | A | C | A |
| Comp. Ex. 1 | 10 | 100 | 0 | 0 | — | — | — | A | D | A | A |
| Comp. Ex. 2 | 10 | 100 | 0 | 0 | — | — | — | A | D | C | A |
| Comp. Ex. 3 | 2 | 85 | 0 | 15 | 3 | Present | 117 | A | C | A | A |
| Comp. Ex. 4 | 4 | 85 | 0 | 15 | 4 | Present | 137 | A | D | A | A |
| Comp. Ex. 6 | 11 | 85 | 0 | 15 | 6 | Present | 33 | C | A | D | D |

adding the dispersion liquid of the vinyl resin fine particles to the dispersion liquid of the core particles so as to allow the vinyl resin fine particles to be attached onto a surface of each of the core particles.

7. The method for producing a toner according to claim 6, wherein the resin B comprises a crystalline polyester resin.

8. The method for producing a toner according to claim 6, wherein the ratio of the resin B in the vinyl resin fine particles is 10% by mass to 50% by mass.

9. The method for producing a toner according to claim 6, wherein each of the vinyl resin fine particles is formed of a vinyl resin, which is a copolymer of a styrene monomer and another monomer, and wherein the ratio of the styrene monomer in the monomers is 80% by mass or more.

10. The method for producing a toner according to claim 6, wherein each of the vinyl resin fine particles is formed of a vinyl resin, which is polystyrene.

11. An image forming apparatus comprising:

an image bearing member;

a charging unit configured to uniformly charge a surface of the image bearing member;

an exposing unit configured to expose the charged surface of the image bearing member so as to form a latent image thereon;

a developing unit configured to supply a toner to the formed latent image on the surface of the image bearing member so as to form a visible image;

a cleaning unit configured to clean the remaining toner on the surface of the image bearing member;

a transferring unit configured to transfer the visible image on the surface of the image bearing member via an intermediate transfer medium or directly to a recording medium; and a fixing unit configured to fix the visible image on the recording medium;

wherein the toner comprises:

core particles each containing at least a resin A having a polyester skeleton and a colorant; and vinyl resin fine particles each of which encapsulates a resin B having at least a polyester skeleton and an endothermic peak measured by differential scanning calorimeter (DSC) at 40° C. to 110° C., and wherein the vinyl resin fine particles are attached onto each of the core particles.

* * * * *